United States Patent [19]

Otani

[11] Patent Number: 5,043,256

[45] Date of Patent: Aug. 27, 1991

[54] COLOR PHOTOGRAPHIC MATERIAL

[75] Inventor: Shigeaki Otani, Kanagawa, Japan

[73] Assignee: Fuji Photo Film Co., Ltd., Kanagawa, Japan

[21] Appl. No.: 413,152

[22] Filed: Sep. 27, 1989

[30] Foreign Application Priority Data

Sep. 27, 1988 [JP] Japan ..... 63-239599
Jul. 10, 1989 [JP] Japan ..... 1-175732

[51] Int. Cl.[5] ..... G03C 7/38; G03C 1/34
[52] U.S. Cl. ..... 430/550; 430/551
[58] Field of Search ..... 430/551, 550, 558 R

[56] References Cited

U.S. PATENT DOCUMENTS

| | | | |
|---|---|---|---|
| H 706 | 11/1989 | Takahashi et al. | 430/551 |
| 4,704,350 | 11/1987 | Morigaki et al. | 430/551 |
| 4,720,451 | 1/1988 | Shuto et al. | 430/544 |
| 4,839,263 | 6/1989 | Miyoshi et al. | 430/551 |
| 4,898,811 | 2/1990 | Wolff et al. | 430/551 |
| 4,912,026 | 3/1990 | Miyoshi et al. | 430/551 |

FOREIGN PATENT DOCUMENTS

| | | | |
|---|---|---|---|
| 228655 | 7/1987 | European Pat. Off. . | |
| 230048 | 7/1987 | European Pat. Off. . | |
| 0258662 | 3/1988 | European Pat. Off. | 430/551 |
| 0277589 | 8/1988 | European Pat. Off. | 430/551 |
| 298321 | 1/1989 | European Pat. Off. . | |
| 0328023 | 8/1989 | European Pat. Off. | 430/551 |
| 824082 | 12/1978 | Fed. Rep. of Germany . | |

*Primary Examiner*—Richard L. Schilling
*Attorney, Agent, or Firm*—Sughrue, Mion, Zinn Macpeak & Seas

[57] ABSTRACT

A silver halide color photographic material having at least one silver halide emulsion layer containing substantially no silver iodide and comprising silver chloride or silver chlorobromide grains having an average silver chloride content of not less than 10 mol % and containing at least $10^{-9}$ mol (per mol of silver halide) of Group VIII metal ion of the Periodic Table, Group II transition metal ion of the Periodic Table, lead ion or thallium ion provided on a reflection type support, said silver halide emulsion layer contains at least one member of pyrazoloazole couplers represented by the following general formula (I) and said silver halide color photographic material contains at least one member of compounds represented by the following general formulas (II) and (III) and at least one member of compounds represented by the following general formula (IV)

(I)

wherein Za and Zb, $R_1$ and $R_2$ and $X_1$ are defined in the specification; at least one of $R_1$ and $R_2$ is a group which is attached to pyrazoloazole nucleus through secondary or tertiary carbon.

(II)

(III)

wherein $R_3$ and $R_4$ represent each an aliphatic group, an aromatic group or a heterocyclic group; $X_2$ represents a group which is eliminated by the reaction with an aromatic amine developing agent; A represents a group which forms a chemical bond by the reaction with an aromatic amine developing agent; n represents 1 or 0; B represents hydrogen atom, an aliphatic group, an aromatic group, a heterocyclic group, an acyl group or a sulfonyl group; Y is a group which accelerates the addition of the aromatic amine developing agent to the compound having the formula (III); and $R_3$ and $X_2$ or Y and $R_4$ or B may be combined together to form a ring structure.

(IV)

wherein $M_2$ represents hydrogen atom, a cation or —S—D; and D represents a residue of a heterocyclic ring containing at least one nitrogen atom.

19 Claims, No Drawings

COLOR PHOTOGRAPHIC MATERIAL

FIELD OF THE INVENTION

This invention relates to a silver halide color photographic material, and more particularly to a silver halide color photographic material which is excellent in color reproducibility, scarcely forms stain after processing and has excellent stability against processing.

BACKGROUND OF THE INVENTION

Silver halide color photographic materials comprise generally silver halide emulsion layers which are sensitive to light of each of the three primary colors of blue, green and red and develop yellow, magenta and cyan colors. Namely, a dye image is reproduced by subtractive color photography. Accordingly, the dye image to be reproduced is greatly affected by the color-sensitive characteristics of each layer and the spectral absorption characteristic of developed colors. Generally, these characteristics can be not always set to the theoretical optimum conditions, because the conditions are restricted by various factors such as the developability of compounds. Particularly, the developed hue of magenta couplers is an important factor to color reproducibility, and attempts to improve magenta couplers have been made [see, JP-A-49-74027 (the term "JP-A" as used herein means an "unexamined published Japanese patent application"), JP-A-49-111631, etc.]. It has been found that pyrazoloazole type magenta couplers scarcely cause unnecessary secondary absorption and are advantageous in color reproducibility (see, U.S. Pat. No. 3,725,067, etc.).

However, these pyrazoloazole type magenta couplers have serious problems to color photographs in that they are reacted with the oxidants of aromatic amine compounds left behind in photographic materials after processing and as a result, magenta stain is formed after long-term storage.

As a means for preventing said magenta stain from being formed, there has been proposed a method wherein a compound (a) and a compound (b) are incorporated in photographic materials, said compound (a) reacting with aromatic amine color developing agent left after color development to form a compound which is chemically inactive and substantially colorless, and said compound (b) reacting with the oxidant of the aromatic amine color developing agent left after color development to form a compound which makes the oxidant chemically inactive [see, EP-A-0277589 (the term "EP-A" as used herein means an "unexamined published European patent application")].

However, the photographic materials containing the above compounds, cause such serious problems that when the pH values of color developing agents are changed, sensitivity and gradation are greatly affected thereby and color prints having constant quality cannot be obtained.

Silver chloride content is conventionally increased to shorten color development time. However, the photographic materials containing such high silver chloride emulsions have disadvantages in that when the pH values of the color developing agents are changed as mentioned above, sensitivity and gradation are remarkably influenced thereby.

SUMMARY OF THE INVENTION

The first object of the present invention is to provide a color photographic material which gives magenta dye image having good spectral absorption characteristics and hence is more excellent in color reproducibility.

The second object of the present invention is to provide a color photographic material which scarcely causes the formation of magenta stain.

The third object of the present invention is to provide a color photographic material which scarcely causes a change in sensitivity and gradation when the pH values of the color developing agents are change.

The fourth object of the present invention is to provide a color photographic material which enables rapid processing to be conducted.

The present inventors have made studies to find out a silver halide color photographic material which meets the above requirements. As a result, the above objects have been achieved by providing a silver halide color photographic material having at least one silver halide emulsion layer containing substantially no silver iodide and comprising silver chloride or silver chlorobromide grains having an average silver chloride content of not less than 10 mol % and containing at least $10^{-9}$ mol (per mol of silver halide) of Group VIII metal ion of the Periodic Table, Group II transition metal ion of the Periodic Table, lead ion or thallium ion provided on a reflection type support, characterized in that said silver halide emulsion layer contains at least one member of pyrazoloazole couplers represented by the following general formula (I) and said silver halide color photographic material contains at least one member of compounds represented by the following general formulas (II) and (III) and at least one member of compounds represented by the following general formula (IV).

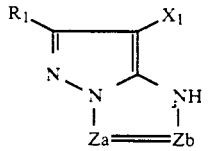

(I)

In the formula (I), Za and Zb each represent

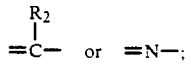

$R_1$ and $R_2$ each represent hydrogen atom or a substituent group; and $X_1$ is hydrogen atom or a group which is eliminated by the coupling reaction with the oxidant of an aromatic primary amine developing agent. When Za=Zb linkage is a carbon-to-carbon double bond, the linkage may be a portion of the aromatic ring. A dimer or polymer may be formed by $R_1$, $R_2$ or $X_1$. At least one of $R_1$ and $R_2$ is a group which is attached to pyrazoloazole nucleus through secondary or tertiary carbon.

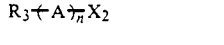

(II)

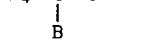

(III)

In the formulas (II) and (III), $R_3$ and $R_4$ represent each an aliphatic group, an aromatic group or a heterocyclic group; $X_2$ represents a group which is eliminated by the reaction with an aromatic amine developing agent; A represent a group which forms a chemical bond by the reaction with an aromatic amine developing agent; n represents 1 or 0; B represents hydrogen atom, an aliphatic group, an aromatic group, a heterocyclic group, an acyl group or a sulfonyl group; and Y is a group which accelerates the addition of the aromatic amine developing agent to the compound having the formula (III).

$R_3$ and $X_2$ or Y and $R_4$ or B may be combined together to form a ring structure.

$$D—S—M_2 \qquad (IV)$$

In the formula (IV), $M_2$ represents hydrogen atom, a cation or —S—D; and D represents a residue of a heterocyclic ring containing at least one nitrogen atom.

DETAILED DESCRIPTION OF THE INVENTION

Now, the present invention will be illustrated in more detail below.

The compounds having the formula (I) can be synthesized according to the methods described in the literature described in E. J. Birr, *Stabilization of Photographic Silver Halide Emulsions* (Focal Press, 1974), C. G. Barlow et al, *Rep. Prog. Appln. Chem.*, vol. 59, page 159 (1974) and *Research Disclosure* No. 17643 (1978).

In the magenta couplers having the formula (I), Za is preferably $$=\overset{R^2}{\overset{|}{C}}—.$$

When Zb is =N—, $R_2$ is preferably a group other than a substituted or unsubstituted aralkyl group.

The substituent group represented by $R^1$ and $R^2$ has the same meaning as in the definition of $R^{11}$, $R^{12}$ and $R^{13}$ hereinafter disclosed. $X_1$ represents the same meaning as in the definition of $X_{11}$ hereinafter disclosed.

In the compounds having the formula (I), the term "a dimer or polymer" as used herein means a compound composed of at least two groups represented by the formula (I). For example, the term "a dimer and polymer" include a bis-compound or a polymer coupler. The polymer coupler may be a homopolymer composed of a monomer having a moiety represented by the formula (I), preferably, a monomer having vinyl group (hereinafter referred to as vinyl monomer), alone, or may be a copolymer of said monomer with a non-color developing ethylenic monomer which is not coupled with the oxidant of aromatic primary amine developing agents.

Among the pyrazoloazole magenta couplers having the formula (I), compounds having the following formulas (VI), (VII), (VIII), (IX) and (X) are preferred.

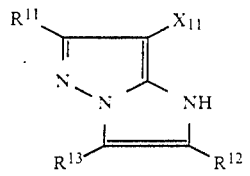

(VI)

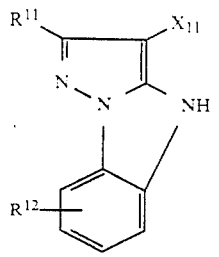

(VII)

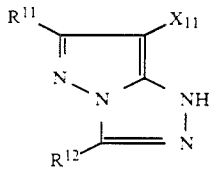

(VIII)

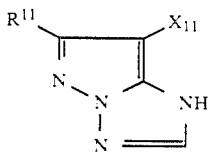

(IX)

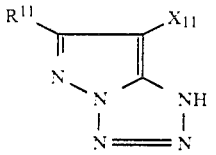

(X)

Among the couplers having the formulas (VI) to (X), the compounds having the formulas (VI), (VIII) and (IX) are preferred and the compounds of the formula (IX) are more preferred.

In the formulas (VI) to (X), $R^{11}$, $R^{12}$ and $R^{13}$ may be the same or different groups and each is hydrogen atom, a halogen atom, an alkyl group, an aryl group, a heterocyclic group, cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, a aryloxycarbonylamino group, a sulfonamido group, a carbamoyl group, an acyl group, a sulfamoyl group, sulfonyl group, sulfinyl group, an alkoxycarbonyl group or an aryloxycarbonyl group; $X_{11}$ is hydrogen atom, a halogen atom, carboxyl group or a group which is bonded to carbon atom at the coupling position through oxygen, nitrogen or sulfur atom and is eliminated by coupling; and $R^{11}$, $R^{12}$ $R^{13}$ or $X_{11}$ may be a divalent group to form a bis-compound or a polymer.

Couplers may be in the form of polymer couplers where the residues of the couplers having the formulas (VI) to (X) exist in the main chains of the polymer couplers or on the side chains thereof. There are particularly preferred polymers derived from vinyl monomers having a moiety represented by one of said formula (VI) to (X). In such a case, $R^{11}$, $R^{12}$ $R^{13}$ or $X_{11}$ is vinyl group or a coupling group.

More specifically, $R^{11}$, $R^{12}$ and $R^{13}$ are each hydrogen atom, a halogen atom (e.g., chlorine, bromine), an alkyl group (e.g., methyl propyl, isopropyl, t-butyl, trifluoromethyl, tridecyl, 2-{α-{3-(2-octyloxy-5-tert-octylbenzenesulfonamido)-phenoxy}tetradecaneamido]ethyl, 3-(2,4-di-t-amylphenoxy)propyl, allyl, 2-dodecyloxyethyl, 1-(2-octyloxy-5-tert-octylbenzenesulfonamido)-2-propyl, 1-ethyl-1-{4-(2-butoxy-5-tert-octylbenzenesulfonamido)phenyl}methyl, 3-phenoxypropyl, 2-hexylsulfonyl-ethyl, cyclopentyl, benzyl, etc.), an aryl group (e.g., phenyl, 4-t-butylphenyl, 2,4 di-t-amylphenyl, 4-tetradecaneamidophenyl, etc.), a heterocyclic group (e.g., 2-furyl, 2-thienyl, 2-pyrimidinyl, 2-benzthiazolyl, etc.), cyano group, an alkoxy group (e.g., methoxy, ethoxy, 2-methoxyethoxy, 2-dodecyloxyethoxy, 2-methanesulfonylethoxy, etc.), an aryloxy group (e.g., phenoxy, 2-methylphenoxy, 4-t-butylphenoxy, etc.), a heterocyclic oxy group (e.g., 2-benzimidazolyloxy, etc.), an acyloxy group (e.g., acetoxy, hexadecanoyloxy, etc.), a carbamoyloxy group (e.g., N-phenylcarbamoyloxy, N-ethylcarbamoyloxy, etc.), a silyloxy group (e.g., trimethylsilyloxy, etc.), a sulfonyloxy group (e.g., dodecylsulfonyloxy, etc.), an acylamino group (e.g., acetamido, benzamido, tetradecaneamido, α-(2,4-di-t-amylphenoxy)butylamido, γ-(3-t-butyl-4-hydroxyphenoxy)butylamido, α-{4-(4-hydroxyphenylsulfonyl)phenoxy}decaneamido, etc.), an anilino group (e.g., phenylamino, 2-chloroanilino, 2-chloro-5-tetradecaneamidoanilino, 2-chloro-5-dodecyloxycarbonyl-anilino, N-acetylanilino, 2-chloro-5-{α-(3-t-butyl-4-hydroxyphenoxy)dodecane}anilino, etc.), a ureido group (e.g., phenylureido, methylureido, N,N-dibutylureido, etc.), an imido group (e.g., succinimido, 3-benzylhydantoinyl, 4-(2-ethylhexanoylamino)phthalimido, etc.), a sulfamoylamino group (e.g., N,N-dipropylsulfamoylamino, N-methyl-decylsulfamoylamino, etc.), an alkylthio group (e.g., methylthio, octylthio, tetradecylthio, 2-phenoxyethylthio, 3-phenoxypropylthio, 3-(4-t-butylphenoxy)propylthio, etc.), an arylthio group (e.g., phenylthio, 2-butoxy-5-t-octylphenylthio, 3-pentadecylphenylthio, 2-carboxyphenylthio, 4-tetradecaneamidophenylthio, etc.), a heterocyclic thio group (e.g., 2-benzothiazoylthio, etc.), an alkoxycarbonylamino group (e.g., methoxycarbonylamino, tetradecyloxycarbonylamino, etc.), an aryloxycarbonylamino group (e.g., phenoxycarbonylamino, 2,4-di-tert-butylphenoxycarbonylamino, etc.), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamide. etc.), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)-propyl}carbamoyl, etc.), an acyl group (e.g., acetyl, (2,4-di-tert-amylphenoxy)acetyl, benzoyl, etc.), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-di-ethylsulfamoyl, etc.), a sulfonyl group (e.g., methanesulfonyl, octanesulfonyl, benzenesulfonyl, toluenesulfonyl, etc.), a sulfinyl group (e.g., octanesulfinyl, dodecylsulfinyl, phenylsulfinyl, etc.), an alkoxycarbonyl group (e.g., methoxycarbonyl, butyloxycarbonyl dodecylcarbonyl, octadecylcarbonyl, etc.), or an aryloxycarbonyl group (e.g., phenyloxycarbonyl, 3-pentadecyloxy-carbonyl, etc.); and $X_{11}$ is hydrogen atom, a halogen atom (e.g., chlorine, bromine, iodine), carboxyl group or a group which is bonded through oxygen atom (e.g., acetoxy, propanoyloxy, benzoyloxy, 2,4-dichlorobenzoyloxy, ethoxyoxazoyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazoylyloxy, 2-benzothiazolyloxy, etc.), a group which is bonded through nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzyl-ethoxy-3-hydantoinyl, 2-N-1,1-di-oxo-3(2H)-oxo-1,2-benzoisothiazolyl, 2-oxo-1,2-dihydro-1-pyridinyl, imidazolyl, pyrazolyl, 3,5-diethyl 1,2,4-triazole-1-yl, 5- or 6-bromobenztriazole-1-yl, 5-methyl-1,2,3,4-triazole-1-yl, benzimidazolyl, 3-benzyl-1-hydantoinyl, 1-benzyl-5-hexadecyloxy-3-hydantoinyl, 5-methyl-1-tetrazoyl, etc.), an arylazo group (e.g., 4-methoxyphenylazo, 4-pivaloylaminophenylazo, 2-naphthylazo, 3-methyl-4-hydroxyphenyl, etc.), or a group which is bonded through sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2 dodecylthio-5-thiophenylthio, 2-phenyl-3-dodecyl-1,2,4-triazole-5-thio, etc.).

In the couplers having the formula (IV), $R^{12}$ and $R^{13}$ may be combined together to form a 5-membered to 7-membered ring.

When $R^{11}$, $R^{12}$, $R^{13}$ or $X_{11}$ is a bivalent group to form a polymer, $R^{11}$, $R^{12}$ and $R^{13}$ each are preferably a substituted or unsubstituted alkylene group (e.g., methylene, ethylene, 1,10-decylene $—CH_2CH_2—O—CH_2CH_2—$, etc.), a substituted or unsubstituted phenylene group (e.g., 1,4-phenylene, 1,3-phenylene,

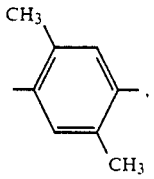

(wherein $R^{14}$ is a substituted or unsubstituted alkylene or phenylene group such as $—NHCOCH_2CH_2CONH—$,

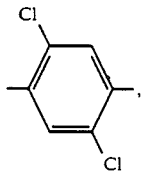

etc.), a group of $—NHCO—R^{14}—CONH—$

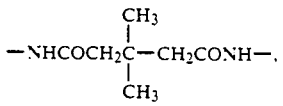

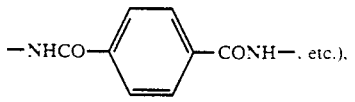

or a group of —S—$R^{15}$—S— (wherein $R^{15}$ is a substituted or unsubstituted alkylene group such as —S—$CH_2CH_2$—S—,

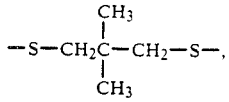

etc.) and $X_{11}$ is a member selected from bivalent groups derived from the monovalent groups already described above in the definition of $X_{11}$.

When the moiety represented by the formulas (VI), (VII), (VIII), (IX) or (X) is included in vinyl monomer, the bonding group represented by $R^{11}$, $R^{12}$, $R^{13}$ or $X_{11}$ includes a group composed of a combination of members selected from the group consisting of an alkylene group (a substituted or unsubstituted alkylene group such as methylene, ethylene, 1,10-decylene, —$CH_2CH_2OCH_2CH_2$—, etc.), a phenylene group (a substituted or unsubstituted phenylene group such as 1,4-phenylene, 1,3-phenylene,

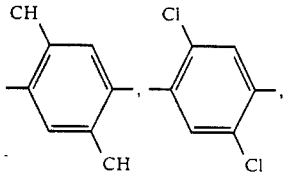

etc.) —NHCO, —CONH—, —O—, —OCO— and an aralkylene group (e.g.,

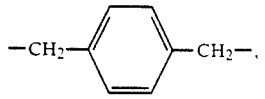

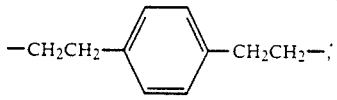

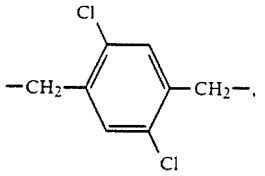

etc.).

Preferred bonding groups include the following groups.

—NHCO—, —$CH_2CH_2$—,

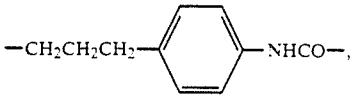

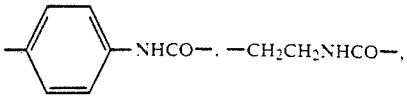

-continued

—$CH_2CH_2$—O—C(=O)—, —CONH—$CH_2CH_2$NHCO—,

—$CH_2CH_2$O—$CH_2CH_2$—NHCO—,

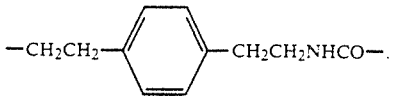

If desired, vinyl group may have substituent groups in addition to the residues of the compounds represented by the formulas (VI), (VII), (VIII), (IX) and (X). Preferred examples of the substituent groups include hydrogen atom, chlorine and a lower alkyl group having from 1 to 4 carbon atoms (e.g., methyl, ethyl).

The monomers having the residues of the compounds represented by the formulas (VI), (VII), (VIII), (IX) and (X) may be copolymerized with non-developing ethylenic monomers which ar not coupled with the oxidants of the aromatic primary amine developing agents to form copolymers.

Examples of the non-developing ethylenic monomers which are not coupled with the oxidants of the aromatic primary amine developing agents include acrylic acid, α-chloroacrylic acid, α-alkylacrylic acids (e.g., methacrylic acid) and esters and amides derived from these acrylic acids (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate and β-hydroxy methacrylate), methylenedibisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic esters, N-vinyl-2-pyrrolidone, N-vinylpyridine and 2- and 4-vinylpyridine. These non-developing ethylenically unsaturated monomers may be used either alone or in a combination of two or more of them. For example, a combination of n-butyl acrylate with methyl acrylate, a combination of styrene with methacrylic acid, a combination of methacrylic acid with acrylamide, a combination of methyl acrylate with di-acetone acrylamide, etc. can be used.

As known in the field of polymer color couplers, the non-developing ethylenically unsaturated monomers to be copolymerized with solid water-insoluble monomer couplers can be so chosen that the resulting copolymers have the desired physical properties and/or chemical properties such as solubility, compatibility with binders such as gelatin, flexibility, thermal stability, etc.

Any of water-soluble polymer couplers and water-insoluble polymer couplers can be used in the present invention. Among them, polymer coupler latex are particularly preferred.

Methods for synthesizing the pyrazoloazole magenta couplers having the formula (I) which can be used in the present invention are described in Japanese Patent Application Nos. 58-23434, 58-151354, 58-45512, 59-27745 and 58-142801 and U.S. Pat. No. 3,061,432.

Typical examples of the magenta couplers which can be used in the present invention include, but are not limited to, the following compounds.

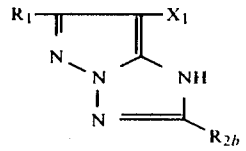
| Compound | $R_1$ | $R_{2b}$ | $X_1$ |
|---|---|---|---|
| I-1 | $CH_3$— | 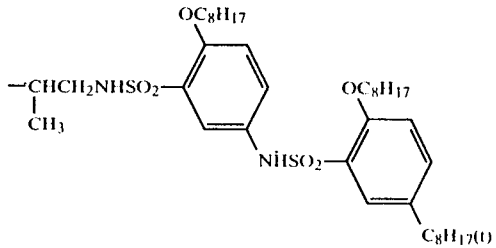 | Cl |
| I-2 | " | 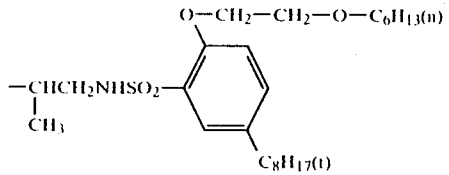 | " |
| I-3 | " | 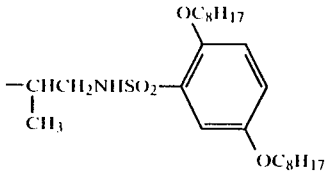 | 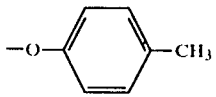 |
| I-4 | 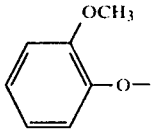 | 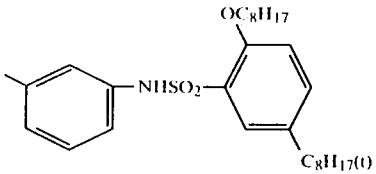 | 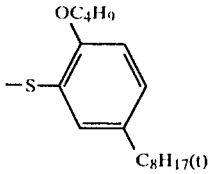 |

-continued
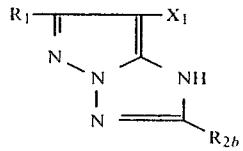
| Compound | $R_1$ | $R_{2b}$ | $X_1$ |
|---|---|---|---|
| I-5 | $CH_3$— | 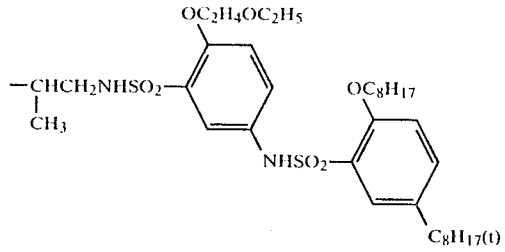 | Cl |
| I-6 | " | 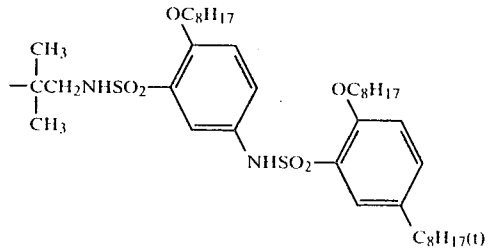 | " |
| I-7 | 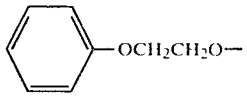 | 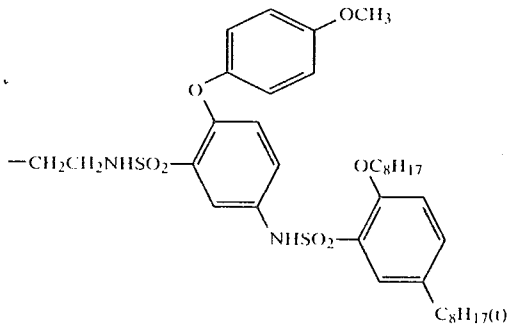 | 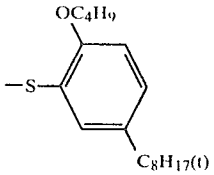 |
| I-8 | $CH_2CH_2O$— | " | " |

-continued
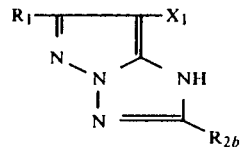
| Compound | $R_1$ | $R_{2b}$ | $X_1$ |
|---|---|---|---|
| I-9 | 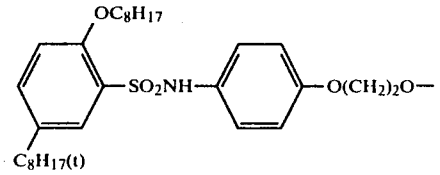 | 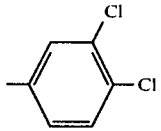 | 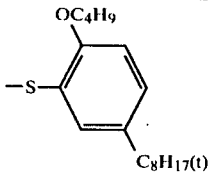 |
| I-10 | 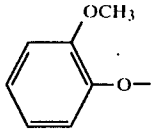 | 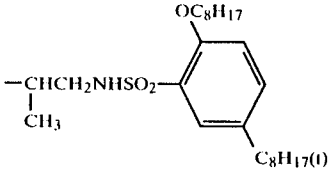 | Cl |
| I-11 | $CH_3$— | 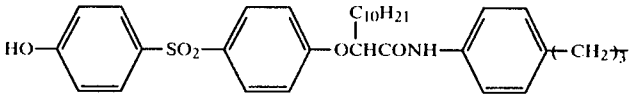 | Cl |
| I-12 | " | 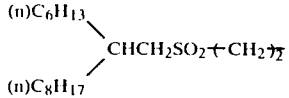 | " |
| I-13 | 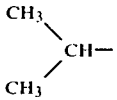 | 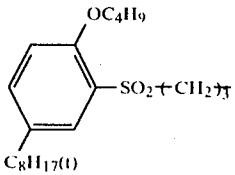 | " |
| I-14 | 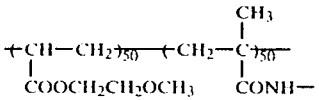 | 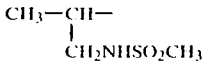 | " |

-continued
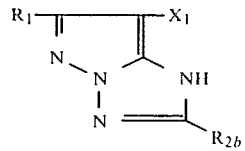
| Compound | $R_1$ | $R_{2b}$ | $X_1$ |
|---|---|---|---|
| I-15 | 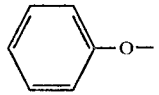 | 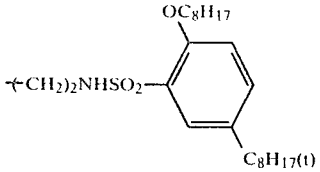 | Cl |
| I-16 | 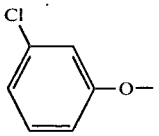 | 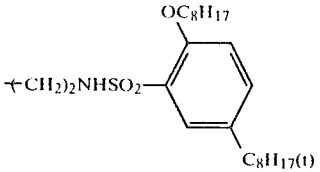 | 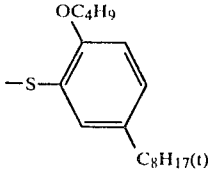 |

It is preferred that the silver halide color photographic material of the present invention contain a compound represented by the following general formula (V).

$$R-Z \qquad (V)$$

In the formula (V), R is an aliphatic group, an aromatic group or a heterocyclic group; and Z is a nucleophilic group or a group which is decomposed in the photographic material to release a nucleophilic group.

Now, the compounds represented by the formulas (II), (III) and (V) will be illustrated in more detail below.

With regard to the compounds having the formulas (II) and (III), there are preferred compounds having a second-order reaction constant $K_2$(80° C.) (in terms of the reaction with p-anisidine) of from 1.0 l/mol.sec to $1\times10^{-5}$ l/mol.sec as measured by the method described in JP-A-63-158545. With regard to the compounds having the formula (V), there are preferred compounds where Z is a group derived from a nucleophilic functional group having a Pearson's nucleophilic $^{n}CH_3I$ value [R. G. Pearson, et al., *J. Am. Chem. Soc.*, 90, 319 (1968)] of 5 or above.

Among the compounds having the formulas (II), (III) and (V), it is preferred that the compounds having the formula (II) or (III) is used together with the compounds having the formula (V).

The groups of the compounds having the formula (II), (III) and (V) are illustrated in more detail below.

The aliphatic group represented by $R_3$, $R_4$, B and R is a straight-chain, branched or cyclic alkyl, alkenyl or alkinyl group. These groups may be optionally substituted. The aromatic group represented by $R_3$, $R_4$, B and R is a carbon ring type aromatic group (e.g., phenyl, naphthyl) or a heterocyclic type aromatic group (e.g., furyl, thienyl, pyrazolyl,pyridyl, indolyl). These groups may be a monocyclic type or a condensed ring type (e.g., benzofuryl, phnanthridinyl). The aromatic ring of these groups may be optionally substituted.

The heterocyclic group represented by $R_3$, $R_4$, B and R is preferably a group having a 3-membered to 10-membered ring structure composed of carbon atom, oxygen atom, nitrogen atom, sulfur atom and hydrogen atom. The heterocyclic ring itself may be a saturated ring or an unsaturated ring, or may be optionally substituted (e.g., chromanyl, pyrrolidyl, pyrrolinyl, morpholinyl).

The group $X_2$ of the formula (II) is a group which is eliminated by the reaction with aromatic amine developing agents, represents a group attached to A through oxygen atom, sulfur atom or nitrogen atom (e.g., 2-pyridyloxy, 2-pyrimidyloxy, 4-pyrimidyloxy, 2-(1,2,3-triazine)oxy, 2-benzimidazolyl, 2-imidazolyl, 2-thiazolyl, 2-benzthiazolyl, 2-furyloxy, 2-thiophenyloxy, 4-pyridyloxy, 3-isoxazolyloxy, 3-pyrazolidinyloxy, 3-oxo-2-pyrazolonyl, 2-oxo-1-pyridinyl, 4-oxo-1-pyridinyl, 1-benzimidazolyl, 3-pyrazolyloxy, 3H-1,2,4-oxadiazoline-5-oxy, aryloxy, alkoxy, alkylthio, arylthio, substituted N-oxy, etc.) or a halogen atom.

The group A of the formula (II) is a group which forms a chemical bond by the reaction with the aromatic amine developing agents and contains a group containing an atom having a low electron density such as $$-L-\overset{\overset{Y}{\|}}{C}-,\ -L-\overset{\overset{Y}{\|}}{S}-,\ -L-\underset{\underset{Y'}{\|}}{\overset{\overset{Y}{\|}}{S}}-,\ -L-\underset{Y'}{\overset{\overset{Y}{\|}}{P}}-,\ -L-\underset{R''}{\overset{R'}{Si}}-.$$

When X is a halogen atom, n is 0. In the above formulas, L is a single bond, an alkylene group (preferably a lower alkylene group), $$-O-,\ -S-,\ -\underset{R'''}{N}-,\ -L'-\overset{\overset{Y}{\|}}{C}-L'',\ -L'-\overset{\overset{Y}{\|}}{S}-L'',\ \text{or}$$

$$-L'-\underset{\underset{Y'}{\|}}{\overset{\overset{Y}{\|}}{S}}-L''-$$

(e.g., carbonyl group, sulfonyl group, sulfinyl group, oxycarbonyl group, phosphonyl group, thiocarbonyl group, aminocarbonyl group, silylcarbonyl groups etc.).

Y has the same meaning as in the formula (III) and Y' has the same meaning as in Y.

R' and R'' may be the same or different groups and each is a group of $-L'''R_3$. R''' is hydrogen atom, an aliphatic group (e.g., methyl, isobutyl, t-butyl, vinyl, benzyl, octadecyl, cyclohexyl, etc.), an aromatic group (e.g., phenyl, pyridyl naphthyl, etc.), a heterocyclic group (e.g., piperidinyl, pyranyl, furanyl, chromanyl, etc.), an acyl group (e.g., acetyl, benzoyl, etc.) or a sulfonyl group (e.g., methanesulfonyl, benzenesulfonyl, etc.).

L', L'' and L''' each are —O—, —S— or $$-\underset{R'''}{N}-.$$

Further, L''' may be a single bond.

Among the groups represented by A, there are preferred bivalent groups represented by $$-O-\overset{\overset{O}{\|}}{C}-,\ -S-\overset{\overset{O}{\|}}{C}-\ \text{and}\ \text{-alkylene-}\overset{\overset{O}{\|}}{C}-.$$

Among the compounds having the formula (II), there are preferred compounds having a second-order reaction constant $k_2$(80° C.) (in terms of the reaction with p-anisidine) of from $1\times10^{-1}$ l/mol.sec to $1\times10^{-5}$ l/mol.sec, represented by the following formulas (II-a), (II-b), (II-c) and (II-d).

$$R_3\text{-Link-}\overset{\overset{O}{\|}}{C}-O-Ar \qquad \text{(II-a)}$$

$$R_3\text{-Link-}\overset{\overset{O}{\|}}{C}-O-\overset{\overset{R_a}{\|}}{C}=\underset{\underset{R_c}{|}}{\overset{\overset{R_b}{|}}{C}} \qquad \text{(II-b)}$$

-continued

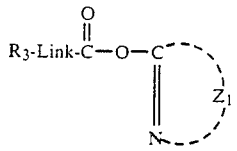

(II-c)

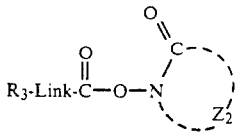

(II-d)

In the above formulas, $R_3$ has the same meaning as in the definition of $R_3$ in the formula (II); Link is a single bond or —O—; Ar is an aromatic group which has the same meaning as in the definitions of $R_3$ $R_4$ and B (however, it is not necessary that a group released therefrom by the reaction with the aromatic amine developing agent is a group useful as a photographic reducing agent such as hydroquinone derivative, catechol derivative or the like); $R_a$, $R_b$ and $R_c$ may be the same or different groups and each is hydrogen atom, an aliphatic group, an aromatic group or a heterocyclic group (said aliphatic, aromatic and heterocyclic groups are the same as those set forth in the definitions of $R_3$, $R_4$ and B). In addition, $R_a$, $R_b$ and $R_c$ each represent an alkoxy group, an aryloxy group, a heterocyclic oxy group, an alkylthio group, an arylthio group, a heterocyclic thio group, an amino group, an alkylamino group, an acyl group, an amido group, a sulfonamido group, a sulfonyl group, an alkoxycarbonyl group, sulfo group, carboxyl group, hydroxyl group, an acyloxy group, a ureido group, a urethane group, a carbamoyl group or a sulfamoyl group.

$R_a$ and $R_b$ or $R_b$ and $R_c$ may be combined together to form a 5-membered to 7-membered heterocyclic ring. The heterocyclic ring may be optionally substituted, may form a spiro ring, a bicyclo ring, etc., or may be condensed with an aromatic ring. $Z_1$ and $Z_2$ each are a non-metallic atomic group required for forming a 5-membered to 7-membered heterocyclic ring. The heterocyclic ring may be optionally substituted, may form a spiro ring, a bicyclo ring, etc., or may be condensed with an aromatic ring.

Among the compounds having the formulas (II-a) to (II-d), the second-order reaction constant $k_2$(80° C.) (in terms of the reaction with p-anisidine) of particularly the compounds having the formula (II-a) can be adjusted by substituent groups to a value of from $1\times10^{-1}$ l/mol.sec to $1\times10^{-5}$ l/mol.sec when Ar is a carbon ring type aromatic group. In this case, the sum total of Hammett's δ values of the substituent groups is preferably at least 0.2, more preferably at least 0.4, most preferably at least 0.6, though the value varies depending on the types of the substituent group $R_3$. The upper limit of the value is preferably 3.0.

When the compounds having the formulas (II-a) to (II-d) are to be added during the course of the preparation of the photographic materials, the sum total of the carbon atoms of the compound itself is preferably at least 13.

For the purpose of achieving the objects of the present invention, compounds which are decomposed during development are not preferred.

Y in the formula (III) is preferably oxygen atom, sulfur atom,

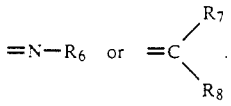

$R_6$, $R_7$ and $R_8$ are each hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyranyl, furanyl, chromanyl), an acyl group (e.g., acetyl, benzoyl) or a sulfonyl group (e.g., methanesulfonyl, benzenesulfonyl). $R_7$ and $R_8$ may combine together to form a ring structure.

Among the compounds having the formulas (II) and (III), the compounds having the formula (II) are preferred. Among them, the compounds having the formulas (II-a) and (II-c) are more preferred. The compounds having the formula (II-a) are particularly preferred.

The group Z in the formula (V) is a nucleophilic group or a group which is decomposed in the photographic material to release a nucleophilic group. There are known nucleophilic groups where atom which is chemically bonded directly to the oxidant of the aromatic amine developing agent is oxygen atom, sulfur atom or nitrogen atom (e.g., amine compounds, azide compounds, hydrazine compounds, mercapto compounds, sulfide compounds, sulfinic acid compounds, cyano compounds, thiocyano compounds, thiosulfuric acid compounds, seleno compounds, halide compounds, carboxy compounds, hydroxamic acid compounds, active methylene compounds, phenolic compounds, nitrogen-containing heterocyclic compounds, etc.).

Among the compounds having the formula (V), compounds having the following formula (V-a) are preferred.

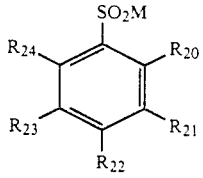

(V-a)

In the formula, M is an atom capable of forming an inorganic salt (e.g., Li, Na, k, Ca, Mg, etc.) or an organic salt (e.g., triethylamine, methylamine, ammonia, etc.), an atomic group capable of forming an inorganic or organic salt, or a group of the formula

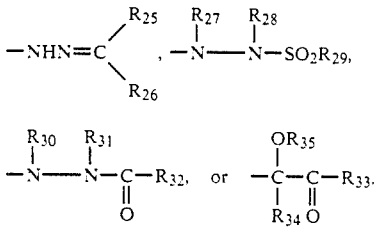

$R_{25}$ and $R_{26}$ may be the same or different groups and each is hydrogen atom, an aliphatic group, an aromatic group or a heterocyclic group, or $R_{25}$ and $R_{26}$ may be combined together to form a 5-membered to 7-membered ring. $R_{27}$, $R_{28}$, $R_{30}$ and $R_{31}$ may be the same or different groups and each is hydrogen atom, an aliphatic group, an aromatic group, a heterocyclic ring, an acyl group, an alkoxycarbonyl group, a sulfonyl group, a ureido group or an urethane group with the proviso that at least one of $R_{27}$ and $R_{28}$ and at least one of $R_{30}$ and $R_{31}$ are hydrogen atom; and $R_{29}$ and $R_{32}$ are each hydrogen atom, an aliphatic group, an aromatic group or a heterocyclic group, and $R_{29}$ is further an alkylamino group, an arylamino group, an alkoxy group, an aryloxy group, an acyl group, an alkoxycarbonyl group or an aryloxycarbonyl group. At least two groups of $R_{27}$, $R_{28}$ and $R_{29}$ may be combined together to form a 5-membered to 7-membered ring, and at least two groups of $R_{30}$, $R_{31}$ and $R_{32}$ may be combined together to form a 5-membered to 7-membered ring. $R_{33}$ is hydrogen atom, an aliphatic group, an aromatic group or a heterocyclic group; $R_{34}$ is hydrogen atom, an aliphatic group, an aromatic group, a halogen atom, an acyloxy group or a sulfonyl group; and $R_{35}$ is hydrogen atom or a hydrolyzable group.

$R_{20}$, $R_{21}$ $R_{22}$, $R_{23}$ and $R_{24}$ may be the same or different groups and each is hydrogen atom, an aliphatic group (e.g., methyl, isopropyl, t-butyl, vinyl, benzyl, octadecyl, cyclohexyl), an aromatic group (e.g., phenyl, pyridyl, naphthyl), a heterocyclic group (e.g., piperidyl, pyranyl, furanyl, chromanyl), a halogen atom e.g., chlorine, bromine), $$-SR_{36},\ -OR_{36},\ -\underset{\underset{R_{37}}{|}}{N}-R_{36},$$

an acyl group (e.g., acetyl, benzoyl), an alkoxycarbonyl (e.g., methoxycarbonyl, butoxycarbonyl, cyclohexylcarbonyl, octyloxycarbonyl), an aryloxycarbonyl group (e.g., phenyloxycarbonyl, naphthyloxycarbonyl), a sulfonyl group (e.g., methanesulfonyl, benzenesulfonyl), a sulfonamido group (e.g., methanesulfonamido, benzenesulfonamido), a sulfamoyl group, an ureido group, a urethane group, a carbamoyl group, sulfo group, carboxyl group, nitro group, cyano group, an alkoxalyl group (e.g., methoxalyl, isobutoxalyl, octyloxalyl, benzoyloxalyl), an aryloxalyl group (e.g., phenoxalyl, naphthoxalyl), a sulfonyloxy group (e.g., methanesulfonyloxy, benzenesulfonyloxy),

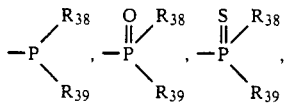

or a formyl group. $R_{36}$ and $R_{37}$ may be the same or different groups and each is hydrogen atom, an aliphatic group, an aromatic group, an acyl group or a sulfonyl group; and $R_{38}$ and $R_{39}$ may be the same or different groups and each is hydrogen atom, an aliphatic group, an aromatic group, an alkoxy group or an aryloxy group. Among them, the cases where the total of Hammett's δ values of benzene substituent groups to $-SO_3M$ group is 0.5 or above, are preferred from the viewpoint of the effect of the present invention.

Typical examples of the compounds represented by formulae (II), (III) and (V) include, but are not limited to, the following compounds.

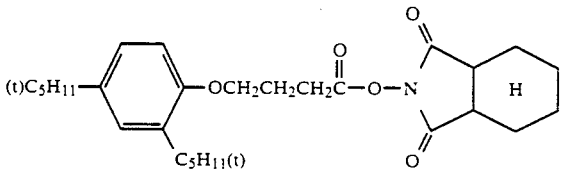

(II-1)

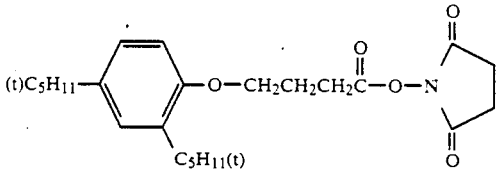

(II-2)

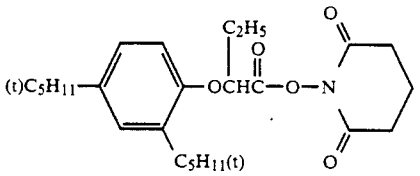

(II-3)

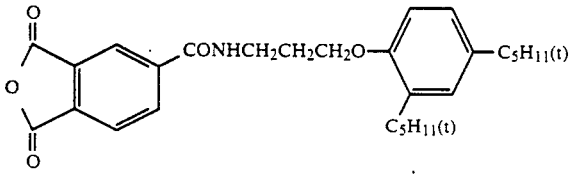

(II-4)

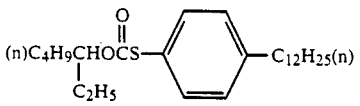

(II-5)

-continued
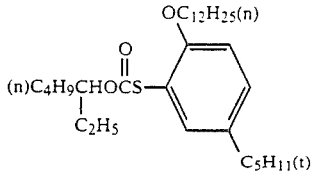
(II-6)
(n)$C_{18}H_{37}I$ (II-7)
(n)$C_{18}H_{37}Br$ (II-8)
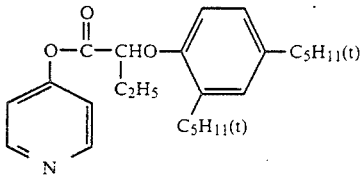
(II-9)
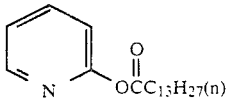
(II-10)
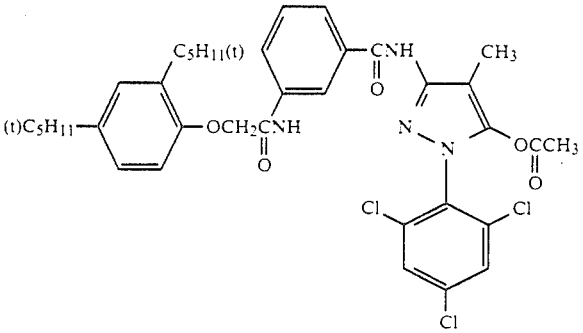
(II-11)
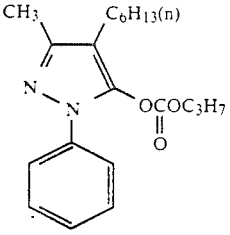
(II-12)
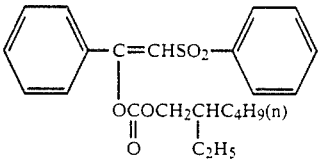
(II-13)
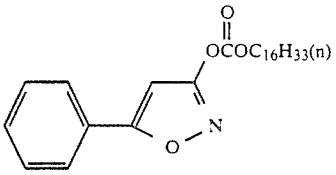
(II-14)
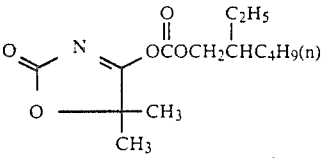
(II-15)

-continued
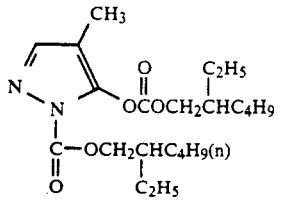
(II-16)
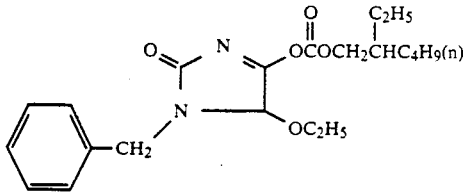
(II-17)
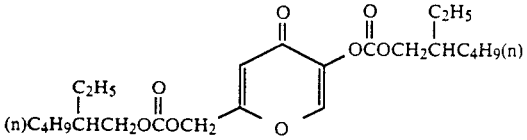
(II-18)
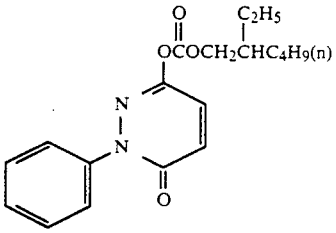
(II-19)
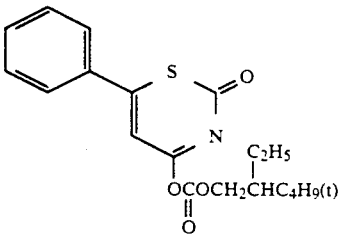
(II-20)
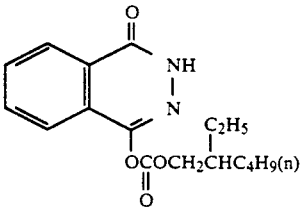
(II-21)
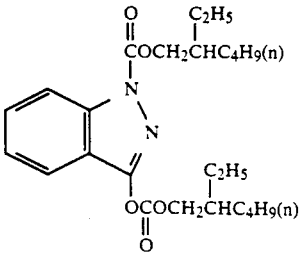
(II-22)

-continued
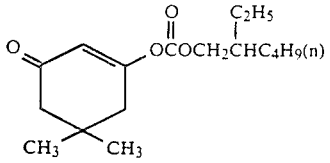
(II-23)
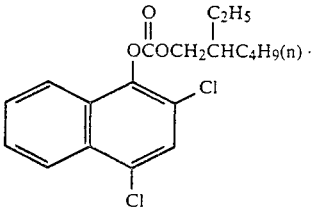
(II-24)
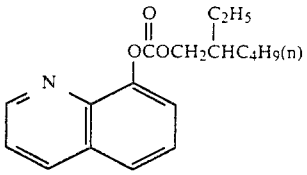
(II-25)
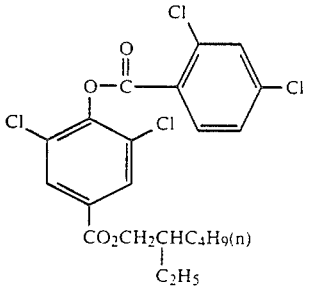
(II-2
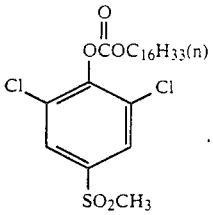
(II-27)
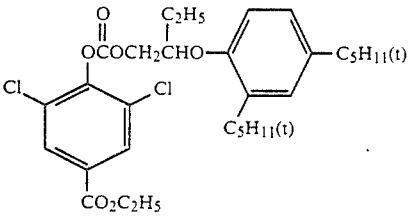
(II-28)
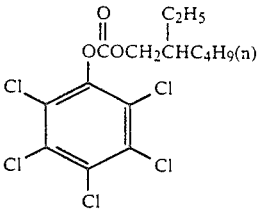
(II-29)

-continued
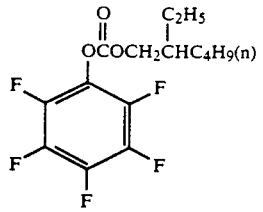
(II-30)
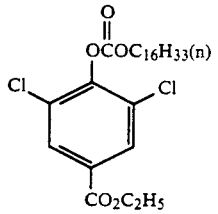
(II-31)
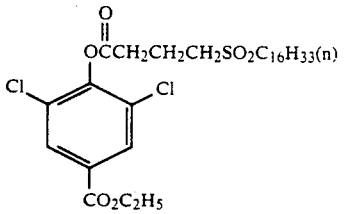
(II-32)
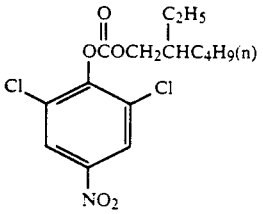
(II-33)
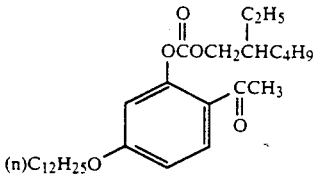
(II-34)
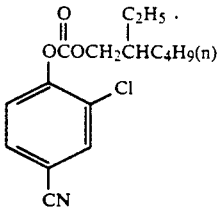
(II-35)
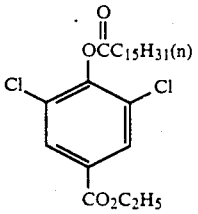
(II-36)
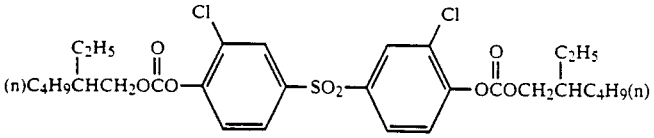
(II-37)

-continued
(II-38)
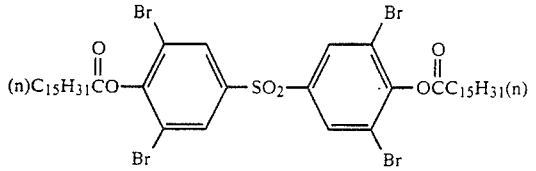
(II-39)
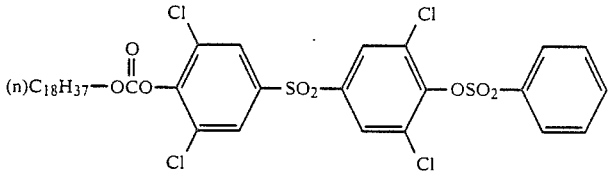
(II-40)
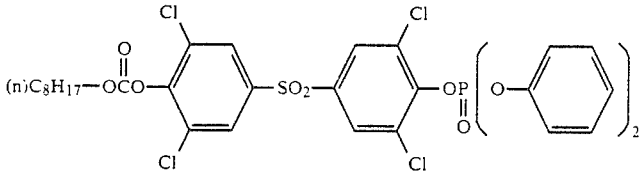
(II-41)
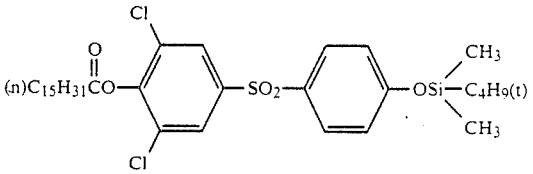
(II-42)
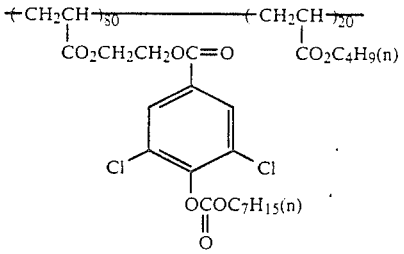
(II-43)
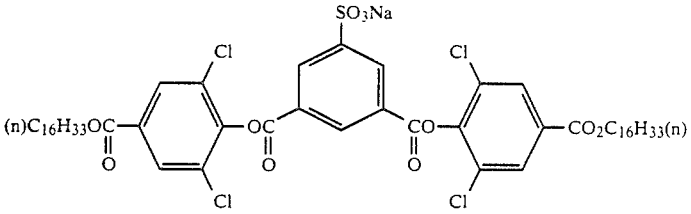
(II-44)
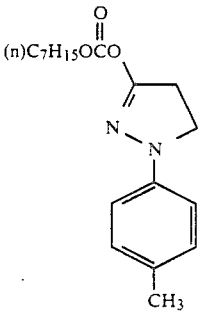

-continued
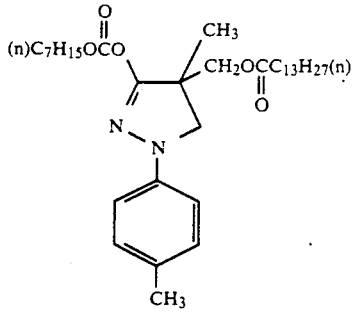
(II-45)
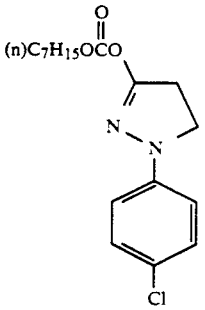
(II-46)
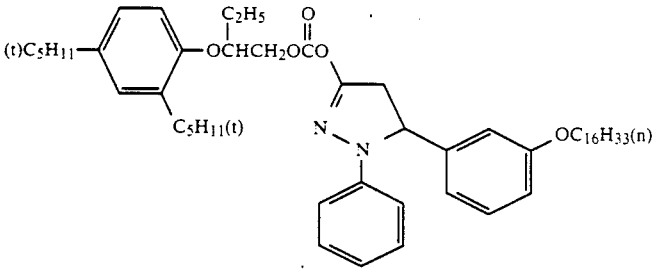
(II-47)
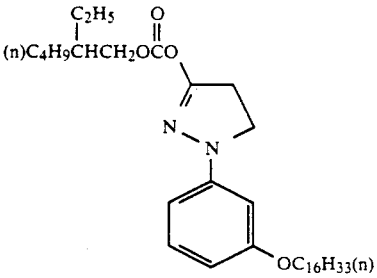
(II-48)
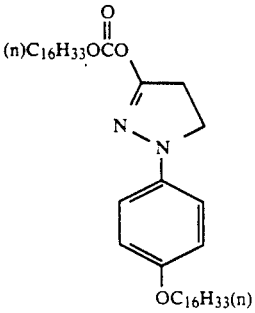
(II-49)

-continued
(II-50)
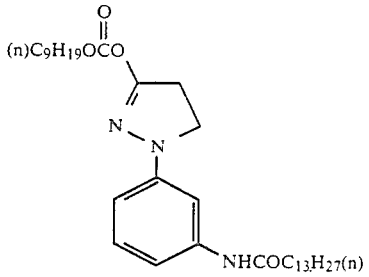
(II-51)
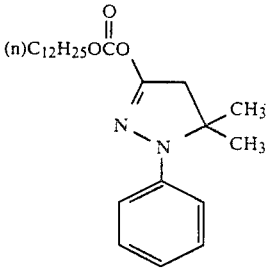
(III-1)
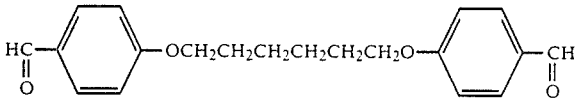
(III-2)
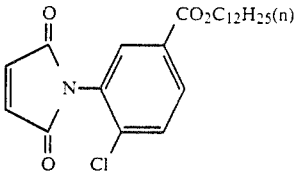
(III-3)
$CH_2{=}CH{-}SO_2{-}C_{18}H_{37}(n)$
(III-4)
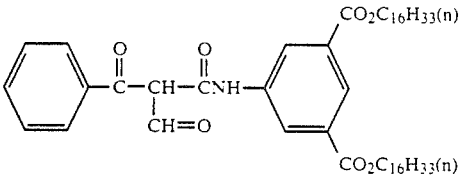
(III-5)
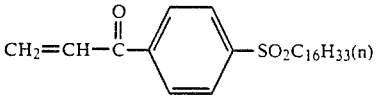
(V-1)
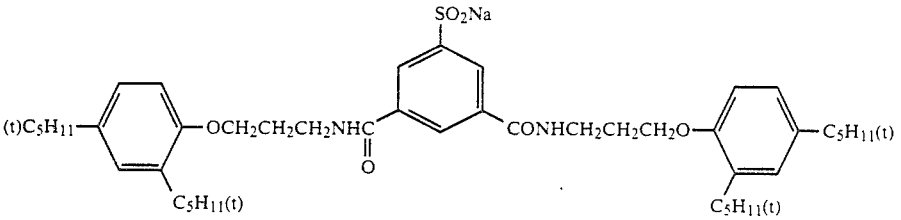
(V-2)
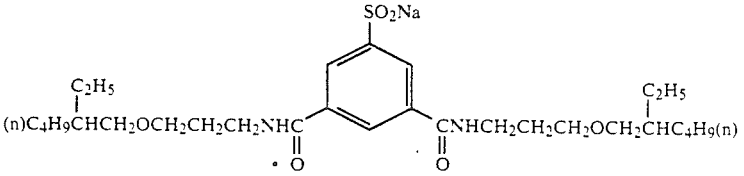

-continued
(V-3)
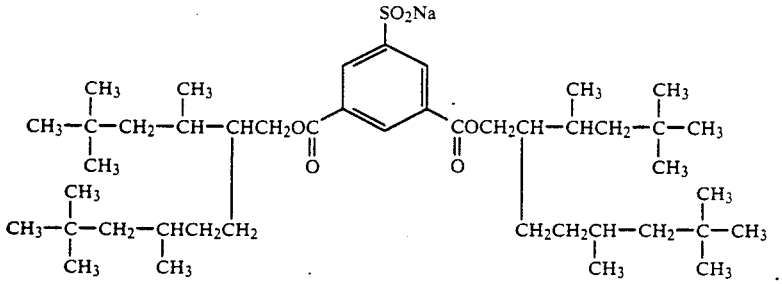
(V-4)
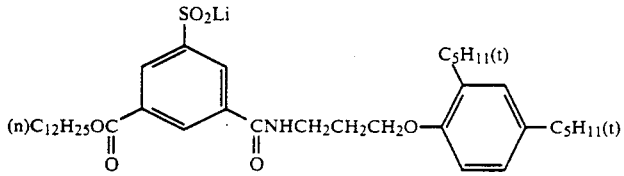
(V-5)
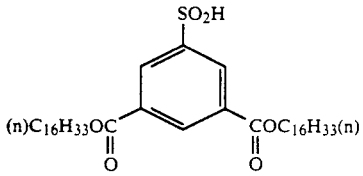
(V-6)
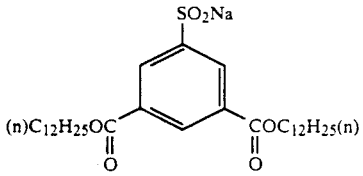
(V-7)
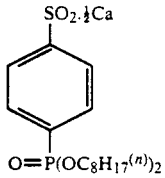
(V-8)
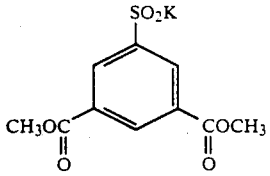
(V-9)
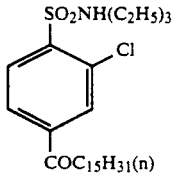
(V-10)
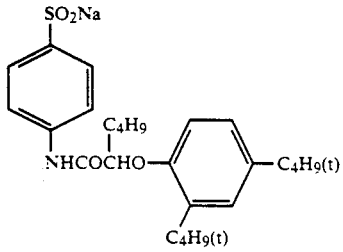

-continued
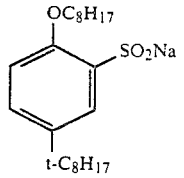
(V-11)
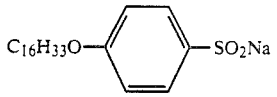
(V-12)
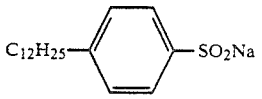
(V-13)
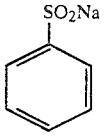
(V-14)
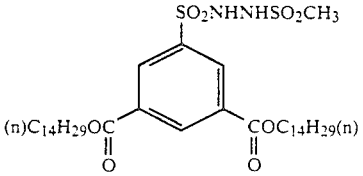
(V-15)
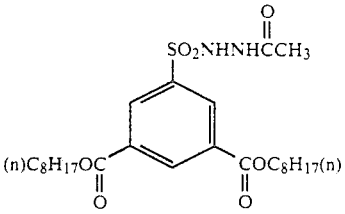
(V-16)
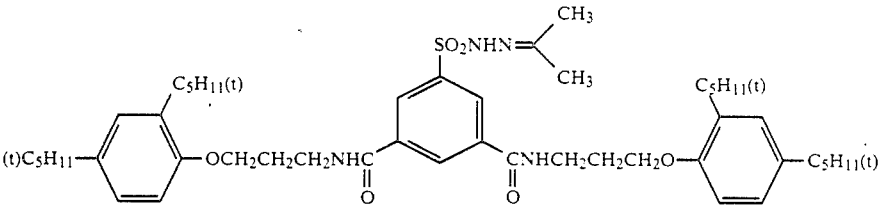
(V-17)
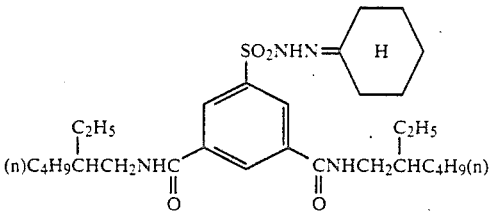
(V-18)
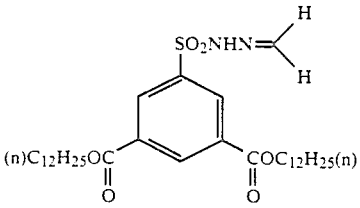
(V-19)

-continued
(V-20)
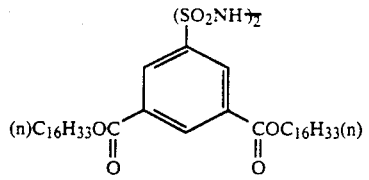
(V-21)
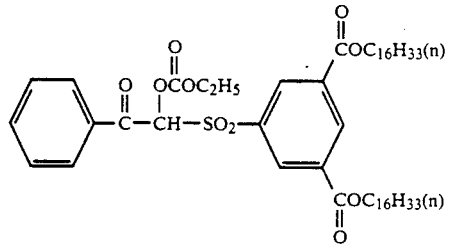
(V-22)
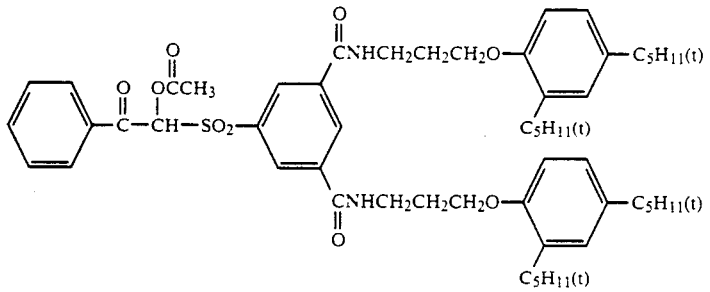
(V-23)
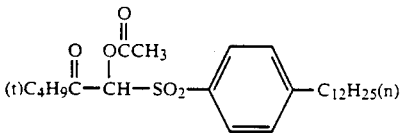
(V-24)
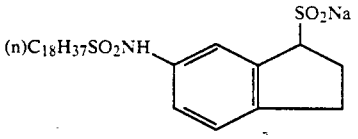
(V-25)
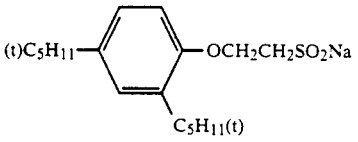
(V-26)
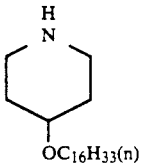
(V-27)
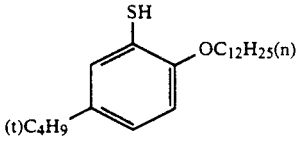
(V-28)
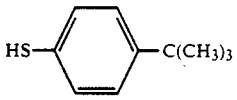

-continued

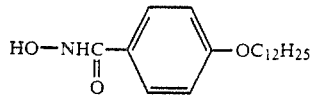

(V-29)

$NaN_3$ (V-30)

These compounds can be synthesized according to the methods described in JP-A-62-143048, JP-A-63-115855, JP-A-63-115866, JP-A-63-158545 and EP-A-255722.

Other examples of the preferred compounds which can be used in the present invention include those described in JP-A-62-283338 and JP A-62-229145.

The compounds having the formula (II) and/or the compounds having the formula (III) and optionally the compounds having the formula (V) can be incorporated in the photographic material by adding them to hydrophilic colloid layers during the course of the manufacture of the photographic material. Generally, hydrophilic colloid solutions for coating can be prepared by dissolving them in a high-boiling solvent (oil) having a boiling point of not lower than 170° C. under atmospheric pressure, a low-boiling solvent or a mixture of said oil and said low-boiling solvent and emulsifying and dispersing the resulting solution in an aqueous solution of hydrophilic colloid such as gelatin.

The compounds having the formulas (II), (III) and (V) which are soluble in high-boiling organic solvents, are preferred. It is preferred that the compounds having the formulas (II), (III) and (V) are co-emulsified together with the couplers from the viewpoint of the effect of the present invention. The ratio of the oil/the coupler is preferably from 0.01 to 2.0 by weight.

The amount of the compounds having the formulas (II) and/or (III) and the compounds having the formula (V) to be used each are in the range of $1\times10^{-2}$ to 10 mol, preferably $3\times10^{-2}$ to 5 mol per mol of the coupler. When the amount is less than the above lower limit, the effect of the present invention can be hardly obtained, while when the amount is too large, color forming reaction is liable to be adversely effected. The compounds having the formulas (II), (III), (IV) and/or (V) are preferably incorporated into a silver halide emulsion layer containing a compound represented by formula (I). The silver halide emulsion layer in which the compounds of formulas (I), (II), (III), (IV) and/or (V) are incorporated is generally a green-sensitive layer, but not limited thereto, and, for example, may be a red-sensitive layer or an infrared-sensitive layer in a photographic material intended to be exposed to infrared rays.

Now, the compounds represented by the formula (IV) will be illustrated in more detail below.

$$D-S-M_2 \qquad (IV)$$

In the formula (IV), $M_2$ is hydrogen atom, a cation (e.g., an alkali metal ion, ammonium ion, etc.) or a group of —S—D; and D is a residue of a heterocyclic ring containing at least one nitrogen atom.

The residue of a heterocyclic ring, represented by D in the formula (IV) may be further condensed. Preferred examples thereof include imidazole, triazole, tetrazole, thiazole, oxazole, selenazole, benzimidazole, benzoxazole, benzthiazole, thiadiazole, oxadiazole, benzselenazole, pyrazole, pyrimidine, pyridine, naphthothiazole, naphthoimidazole, naphthoxazole, azabenzimidazole, purine, and azaindene (e.g., triazaindene, tetraazaindene, pentaazaindene, etc.).

These residue of heterocyclic rings and condensed rings may be optionally substituted. Examples of substituent groups include an alkyl group (e.g., methyl, ethyl, hydroxyethyl, trifluoromethyl, sulfopropyl, dipropylaminoethyl, adamantane, etc.), an alkenyl group (e.g., allyl, etc.), an aralkyl group (e.g., benzyl, p-chlorophenethyl, etc.), an aryl group (e.g., phenyl, naphthyl, p-carboxyphenyl, 3,5-dicarboxyphenyl, m-sulfophenyl, p-acetamidophenyl, 3-capramidophenyl, p-sulfamoylphenyl, m-hydroxyphenyl, p-nitrophenyl, 3,5-dichlorophenyl, 2-methoxyphenyl, etc.), a residue of a heterocyclic ring (e.g., pyridine, furan, thiophene, etc.), a halogen atom (e.g., chlorine, bromine, etc.), a mercapto group, cyano group, carboxyl group, sulfo group, hydroxyl group, a carbamoyl group, a sulfamoyl group, amino group, nitro group, an alkoxy group (e.g., methoxy, etc.), an aryloxy group (e.g., phenoxy, etc.), an acyl group (e.g., acetyl group, etc.), an acylamino group (e.g., acetylamino, capramido, methylsulfonylamino, etc.), a substituted amino group (e.g., diethylamino, hydroxyamino, etc.), an alkyl- or arylthio group (e.g., methylthio, carboxyethylthio, sulfobutylthio, etc.), an alkoxycarbonyl group (e.g., methoxycarbonyl, etc.) and an aryloxycarbonyl group (e.g., phenoxycarbonyl, etc.)

The amounts of these mercapto compounds to be added are in the range of preferably $1\times10^{-6}$ to $1\times10^{-2}$ mol, more preferably $1\times10^{-4}$ to $1\times10^{-2}$ mol per mol of silver halide. These mercapto compounds may be added during the formation of grains of silver halide emulsions, during chemical ripening, during the preparation of emulsified dispersion or during the preparation of coating solution. It is preferred that the mercapto compounds are added in a stage after chemical ripening.

Examples of the mercapto compounds having the formula (IV) which can be used in the present invention include the following compounds.

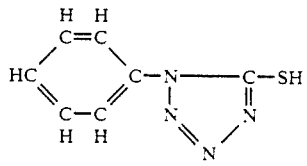

(IV-1)

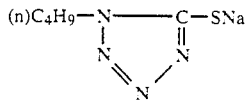

(IV-2)

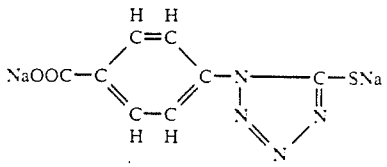

(IV-3)

-continued
(IV-4)
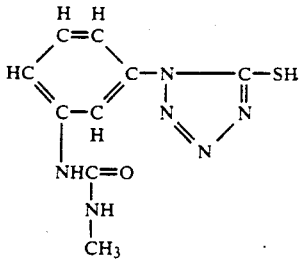
(IV-5)
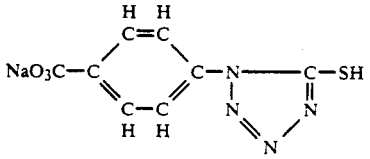
(IV-6)
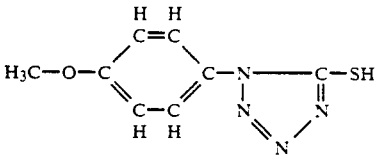
(IV-7)
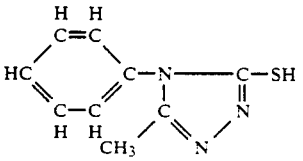
(IV-8)
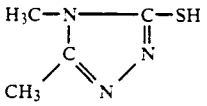
(IV-9)
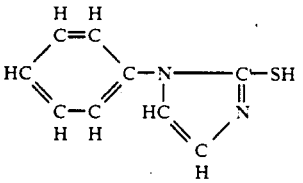
(IV-10)
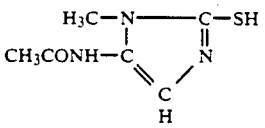
(IV-11)
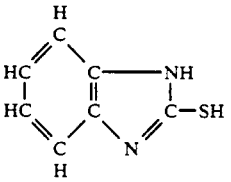
(IV-12)
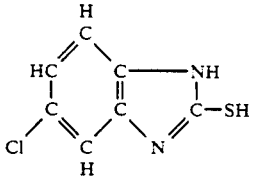
-continued
(IV-13)
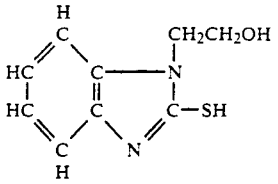
(IV-14)
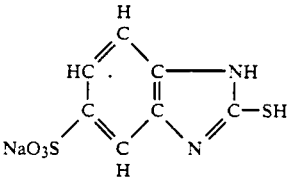
(IV-15)
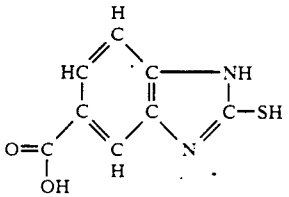
(IV-16)
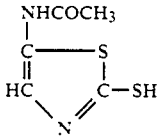
(IV-17)
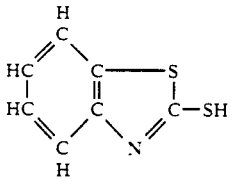
(IV-18)
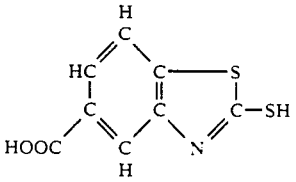
(IV-19)
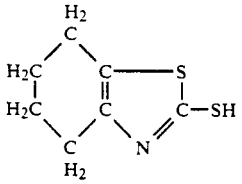
(IV-20)
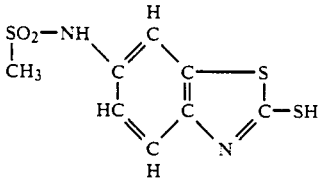
(IV-21)
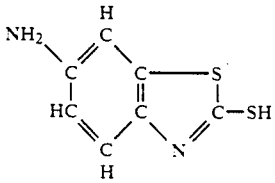

-continued
(IV-22)
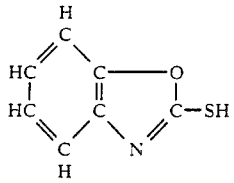
(IV-23)
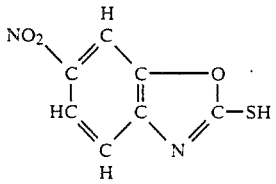
(IV-24)
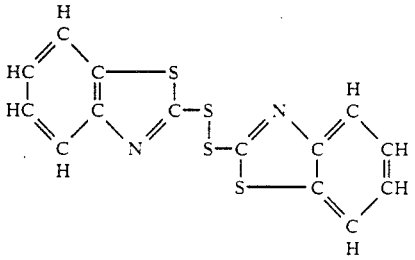
(IV-25)
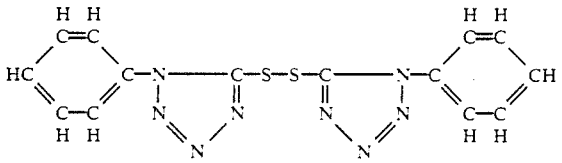
(IV-26)
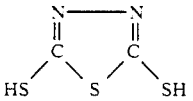
(IV-27)
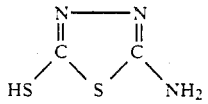
(IV-28)
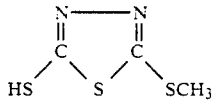
(IV-29)
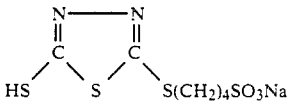
(IV-30)
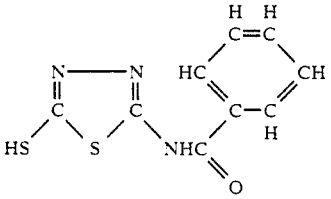
(IV-31)
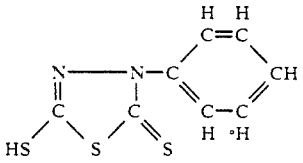
-continued
(IV-32)
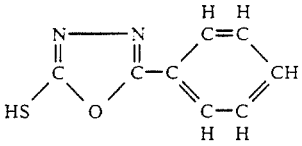
(IV-33)
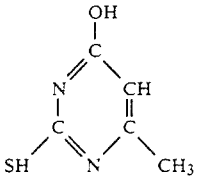
(IV-34)
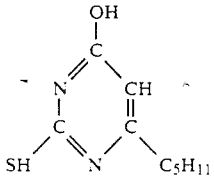
(IV-35)
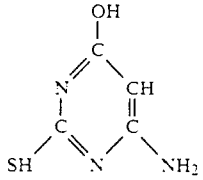
(IV-36)
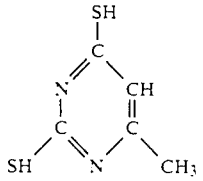
(IV-37)
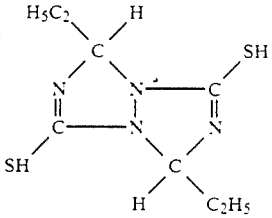
(IV-38)
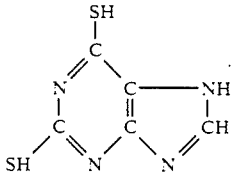
(IV-39)
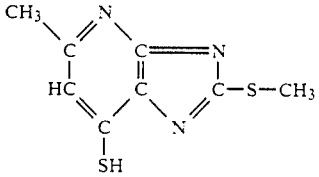
(IV-40)
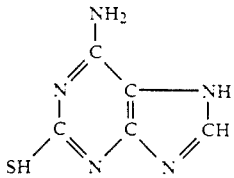

-continued

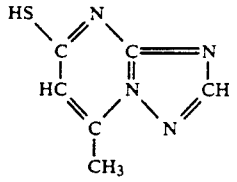

(IV-41)

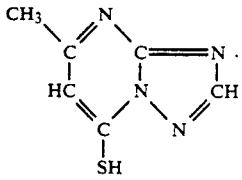

(IV-42)

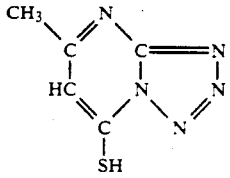

(IV-43)

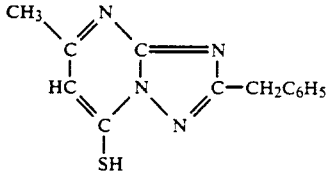

(IV-44)

For the purpose of the present invention, the silver halide emulsion of the present invention has a mean grain size of preferably 0.1 μm to 2 μm, more preferably 0.2 μm to 1.3 μm in terms of a diameter of a circle equal to projected area. Further, monodisperse emulsion is preferred in the present invention.

Grain size distribution which represents a degree of monodispersion is preferably 0.2 or less, more preferably 0.15 or less in terms of a coefficient of variation, namely the ratio ($S/\bar{d}$) of statistical standard deviation S to mean grain size ($\bar{d}$).

When a mixture of two or more silver halide emulsions is used, at least one emulsion must have a coefficient of variation within the range described above.

The silver halide grains of the present invention may be a type wherein the interior of grain is different from the surface layer in phase, a multi-phase structure having a jointed structure, a type wherein grain is wholly composed of a uniform phase, or a composite type of these types.

The silver halide grains of the present invention are silver chloride grains having a silver chloride content of not less than 10 mol % and containing substantially no silver iodide. The term "containing substantially no silver iodide" as used herein means that the content of silver iodide is not more than 2 mol %, preferably not more than 1 mol %, most preferably 0%.

The content of silver chloride is preferably not less than 70%, more preferably not less than 90 mol %. Silver chloride content of silver chlorobromide is most preferably not less than 95 mol % and particularly not less than 98 mol %. When silver chlorobromide grains having a silver chloride content of not less than 90 mol % are used, it is preferred that said grains have at least one silver bromide-localized phase in the vicinity of the apexes of the grains.

The silver bromide-localized phase has a silver bromide content of preferably 10 to 70 mol %, more preferably 15 to 70 mol %. The remainder of the phase is composed of silver chloride.

The term "in the vicinity of the apex" as used herein means preferably the area within a regular square wherein one side thereof is a length of about $\frac{1}{3}$ (preferably 1/5) of the diameter of a circle having the same area as the projected area of a silver chlorobromide grain and each angle thereof is formed by the apex of a grain (a point where the edges of a cube or normal crystal grain regarded as a cube intersect with each other). The amount of silver chlorobromide grains having said silver bromide-localized phase accounts for preferably at least 70 mol %, more preferably at least 90 mol % of the amount of the entire silver halide grains contained in the same emulsion layer.

Methods for forming silver chlorobromide grains having said silver bromide-localized phase in the vicinity of the apexes of grains, the positions of said localized phase and methods for measuring the halogen composition of said localized phase are described in, for example, Japanese Patent Application No. 62-319741.

The silver halide emulsions of the present invention may be an internal latent image type emulsion wherein latent image is mainly formed in the interior of grain, or a surface latent image type emulsion wherein latent image is mainly formed on the surface of grain. However, the effect obtained by the present invention is remarkable with the surface latent image type emulsion, preferably a surface latent image type silver chlorobromide emulsion having said silver bromide-localized phase and a silver chloride content of 95 mol % or more (more preferably 98 mol % or more).

The silver halide grains of the present invention may have regular crystal form such as cube, octahedron, dodecahedron or tetradecahedron, irregular crystal form such as sphere or a composite form of these crystal forms. The silver halide grains may be tubular (plate-form) grains. There may be used emulsions wherein tubular grains having the ratio of length/thickness of at least 5, preferably at least 8 account for at least 50% of the entire projected area of grains.

The photographic emulsions of the present invention can be prepared according to the methods described in P. Glafkides, *Chimie et Physique Photographique* (Paul Montel, 1967), G. F. Duffin, *Photographic Emulsion Chemistry* (Focal Press, 1966) and V. L. Zelikman et al., *Making and Coating Photographic Emulsion* (Focal Press, 1964). Namely, any of acid process, neutral process and ammonia process can be used. A soluble silver salt and a soluble halide salt can be reacted in accordance with single jet process, double jet process or a combination thereof. A reverse mixing method in which grains are formed in the presence of excess silver ion, can be used. Further, there can be used controlled double jet process in which pAg value in a liquid phase, in which silver halide is formed, is kept constant. According to this process, there can be obtained a silver halide emulsion wherein crystal form is regular and grain size is approximately uniform.

After the formation of grains, silver halide emulsions are generally subjected to physical ripening, desalting and chemical ripening and then coated.

Conventional solvents (e.g., ammonia, potassium rhodanide or thioethers and thione compounds described in U.S. Pat. No. 3,271,157, JP-A-51-12360, JP-A-53-82408, JP-A-53-144319, JP-A-54-100717 or JP-A-

54-155828) for silver halide can be used in the stage of precipitation, physical ripening or chemical ripening. After physical ripening, soluble silver salt can be removed from emulsion by means of water washing of nudel, flocculation precipitation method or ultrafiltration.

At least one metal ion derived from Group VIII metals of the Periodic Table such as iron, iridium, platinum, palladium, nickel, rhodium, osmium, ruthenium and cobalt, Group II transition metals of the Periodic Table such as cadmium, zinc and mercury, and lead and thallium is incorporated in the silver halide grains of present invention. Among them, transition metal ions such as iron, iridium, platinum, palladium, nickel and rhodium ions are particularly preferred. Examples of compounds containing these ions include, but are not limited to, ferrous arsenate, ferrous bromide, ferrous carbonate, ferrous chloride, ferrous citrate, ferrous fluoride, ferrous formate, ferrous gluconate, ferrous hydroxide, ferrous iodide, iron(II) lactate, ferrous oxalate, ferrous phosphate, iron(II) succinate, ferrous sulfate, ferrous thiocyanate, ferrous nitrate, ammonium iron(II) nitrate, basic ferric acetate, iron(III) albuminate, ammonium iron(III) acetate, ferric bromide, ferric chloride, ferric chromate, ferric citrate, ferric fluoride, ferric formate, ferric glycerophosphate, ferric hydroxide, acid iron(III) phosphate, ferric nitrate, ferric phosphate, ferric pyrophosphate, sodium iron(III) pyrophosphate, ferric thiocyanate, ferric sulfate, ammonium ferric sulfate, guanidine iron(III) sulfate, ammonium ferric citrate, potassium hexacyanoferrate(II), potassium pentacyanoammineferrate(II), ethylenedinitrilotetraacetic acid iron(III) sodium, potassium hexacyanoferrate(III), tris(dipyridyl) iron(III) chloride, potassium pentacyanonitrocylferrate(III), hexaurea iron(III) chloride, iridium(III) chloride, iridium(III) bromide, iridium(IV) chloride, sodium hexachloroiridate(III), potassium hexachloroiridate(IV), hexammineiridium(III) salt, hexammineiridium(IV) salt, trioxalatoiridate(III), trioxalatoiridate(IV), platinum(IV) chloride, potassium hexachloroplatinate(IV), tetrachloroplatinate(II), tetrabromoplatinate(II), sodium tetrakis(thiocyanato)-platinate(VI), hexammineplatinum(IV) chloride, sodium tetrachloropalladate(II), sodium tetrachloropalladate(IV), potassium hexachloropalladate(IV), tetramminepalladium(II) chloride, potassium tetracyanopalladate(II), nickel chloride, nickel bromide, potassium tetrachloroniccolate(II), hexammine nickel(II) chloride, sodium tetracyanoniccolate(II), potassium hexachlororhodate, sodium hexabromorhodate and ammonium hexachlororhodate.

Said metal ions can be incorporated in the localized phase and/or other grain part (substrate) by adding said metal ion before or during the formation of grains or during physical ripening into a preparation liquid. For example, said metal ions are added to an aqueous gelatin solution, an aqueous halide solution, an aqueous silver salt solution or other aqueous solutions to form silver halide grains.

Alternatively, the metal ions can be introduced by previously incorporating the metal ions in fine grains of silver halide, adding them to a desired silver halide emulsion and dissolving said fine grains of silver halide. This method is suitable for use in introducing the metal ions into the silver bromide localized phase present on the surfaces of silver halide grains. Methods for adding the metal ions can be changed by the position of the metal ions where the ions are allowed to exist.

The content of the metal ion in the present invention is not less than $10^{-9}$ mol, preferably $10^{-9}$ to $10^{-2}$ mol, more preferably $10^{-8}$ to $10^{-3}$ mol per mol of silver halide.

The silver halide emulsions of the present invention may be subjected to chemical sensitization. Examples of the chemical sensitization include sulfur sensitization method using sulfur-containing compounds (e.g., thiosulfates, thioureas, mercapto compounds) capable of reacting with active gelatin or silver; reduction sensitization method using reducing materials (e.g., stannous salts, amines, hydrazine derivatives, formamidinesulfinic acid, silane compounds); and noble metal sensitization method using metallic compounds (e.g., gold complex salts and complex salts of Group VIII metals such as Pt, Ir, Pd, Rh, Fe, etc.) These sensitization methods may be used either alone or in a combination of two or more of them.

Among these chemical sensitization methods, sulfur sensitization method and/or gold sensitization method are/is preferred.

In emulsion layers having substantially the same color-sensitivity, two or more monodisperse silver halide emulsions (having preferably a degree of monodispersion within the range of coefficients of variation described above) having different grain sizes can be mixed in the same layer, or can be multi coated in separate layers to meet requirements for the gradation of the color photographic material. Further, two or more polydisperse silver halide emulsions, or combinations or mixtures of polydisperse emulsion with monodisperse emulsion can be used. Alternatively, they may be multicoated.

Preferably, each of blue-sensitive, green-sensitive and red-sensitive silver halide emulsions of the present invention is spectral-sensitized with methine dyes or other dyes so as to give the desired color sensitivity. Examples of the dyes include cyanine dyes, merocyanine dyes, complex cyanine dyes, complex merocyanine dyes, holopolar cyanine dyes, hemicyanine dyes, styryl dyes and hemioxonol dyes. Of them, cyanine dyes, merocyanine dyes and complex merocyanine dyes are most preferable.

Any of nucleuses conventionally used for cyanine dyes as the nucleuses of basic heterocyclic rings can be applied to these dyes. Examples of the nucleuses include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; and nucleuses formed by fusing an alicyclic hydrocarbon ring to the above nucleuses and nucleuses formed by fusing an aromatic hydrocarbon ring to the above nucleuses such as indolenine nucleus, benzindolenine nucleus, indole nuoleus, benzoxazole nucleus, naphthoxazole nucleus, benzothiazole nucleus, naphthothiazole nucleus, benzselenazole nucleus, benzimidazole nucleus and quinoline nucleus. These nucleuses may have substituent groups on carbon atoms.

5-membered to 6-membered heterocyclic nucleuses such as pyrazoline-5-one nucleus, thiohydantoin nucleus, 2-thiooxazolidine-2,4-dione nucleus, thiazolidine-2,4-dione nucleus, rhodanine nucleus and thiobarbituric acid nucleus as nucleuses having a keto-methylene structure can be applied to the merocyanine dyes or the complex merocyanine dyes.

These sensitizing dyes may be used either alone or in a combination of two or more of them. The combinations of the sensitizing dyes are often used for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609 3,837,862 and 4,026,707, U.K. Patents 1,344,281 and 1,507,803, JP-B-43-4936 (the term "JP-B" as used herein means an "examined Japanese patent application"), JP-B-53-12375, JP-A-52-110618 and JP-A-52-109925.

In addition to the sensitizing dyes, a dye which itself does not have a spectral sensitizing activity or a material which does substantially not absorb visible light, but exhibit supersensitizing activity, may be incorporated in the emulsions. For example, amino-stilbene compounds (e.g., those described in U.S. Pat. Nos. 2,933,390, 3,635,721, 3,615,613, 3,615,641, 3,617,295 and 3,635,721 and Japanese Patent Application No. 61-306030) and aromatic or heterocyclic mercapto compounds may be used as supersensitizing dyes for high silver halide emulsions in particular.

When at least one member of compounds represented by the following formulas (p) to (r) is added to the high silver chloride emulsion of the present invention, an increase in minimum density (Dmin) due to scanning unevenness in the unexposed area can be effectively prevented from being causes, particularly an increase in minimum density can be effectively prevented from being caused when gold sensitizing dyes are used. The compounds having the formulas (p) to (r) may be added during the formation of grains, desalting stage or chemical ripening stage or immediately before coating. Preferably, the compounds are added during the formation of grains, desalting stage or chemical ripening stage and particularly before the addition of the gold sensitizing dye.

The compounds having thiosulfonyl group, represented by the following formulas (p), (q) and (r) will be illustrated below.

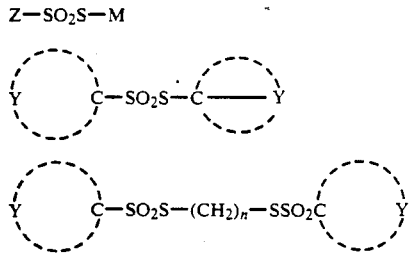

In the formulas, Z is an alkyl group, an aryl group or a heterocyclic group. These groups may be optionally substituted. Y is an atomic group required for the formation of an aromatic ring or a heterocyclic ring. These rings may be optionally substituted. M is a metal atom or an organic cation; and n is an integer of 2 to 10.

Examples of substituent groups for said alkyl group, said aryl group, said aromatic ring and said heterocyclic ring include a lower alkyl group (e.g., methyl, ethyl), an aryl group (e.g., phenyl), an alkoxy group having from 1 to 8 carbon atoms, halogen (e.g., chlorine), nitro group, amino group and carboxyl group.

The alkyl group represented by Z has from 1 to 18 carbon atoms, and the aryl group and the aromatic ring represented by Z and Y have from 6 to 18 carbon atoms.

Examples of heterocyclic rings represented by Z and Y include thiazole, benzthiazole, imidazole, benzimidazole and oxazole rings.

Examples of the metal cation represented by M include alkali metal ions such as sodium ion and potassium ion; and preferred examples of the organic cation include ammonium ion and guanidium ion.

Examples of the compounds represented by the formula (p), (q) or (r) include the following compounds.

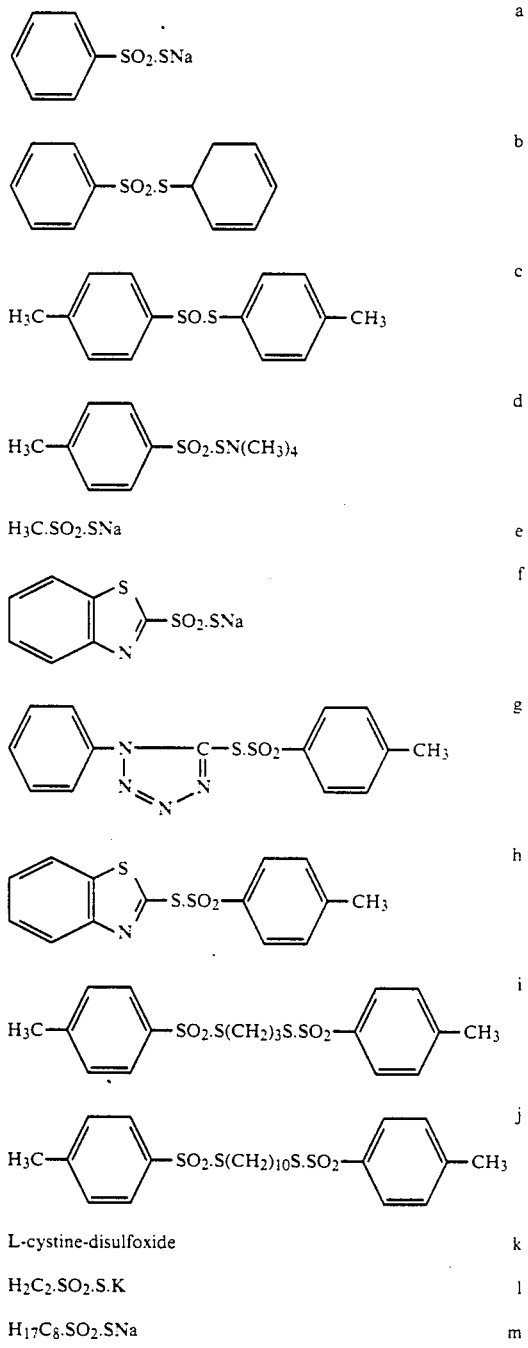

The compounds represented by the formulas (p), (q) and (r) can be used together with sulfinates such as sulfites, alkylsulfinates, arylsulfinates and heterocyclic sulfinates.

The color photographic materials contain generally yellow couplers forming yellow color, magenta couplers forming magenta color and cyan couplers forming cyan color, each of them forming a color by the coupling with the oxidants of the aromatic amine developing agents.

Among the yellow couplers which can be used in the present invention, acylacetamide derivatives such as benzoylacetanilide and pivaloylacetanilide are preferred. Among them compounds having the following formulas [Y-1] and [Y-2] are preferred as the yellow couplers.

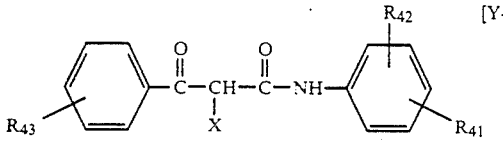

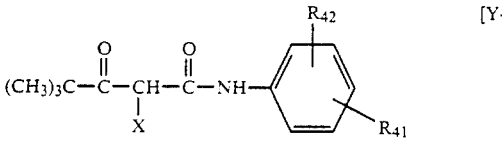

In the formulas, X is hydrogen atom or a coupling elimination group (a group which is eliminated by coupling); $R_{41}$ is a non-diffusing group having from 8 to 32 carbon atoms; $R_{42}$ is hydrogen atom, one or more halogen atoms, a lower alkyl group, a lower alkoxy group or a non-diffusing group having from 8 to 32 carbon atoms; $R_{43}$ is hydrogen atom or a substituent group; and when two or more $R_{43}$ groups exist, they may be the same or different groups.

Pivaloylacetanilide type yellow couplers are described in more detail in U.S. Pat. Nos. 4,622,287 (column 3 line 15 to column 8 line 39) and 4,623,616 (column 14 line 50 to column 19 line 41).

Benzoylacetanilide type yellow couplers are described in U.S. Pat. Nos. 3,408,194, 3,933,501, 4,046,575, 4,133,958 and 4,401,752.

Examples of the pivaloylacetanilide type yellow couplers include compounds (Y-1) to (Y-39) described in U.S. Pat. No. 4,622,287 (column 37 to 54). Among them, there are preferred (Y-1), (Y-4), (Y-6), (Y-7), (Y-15), (Y-21), (Y-22), (Y-23), (Y-26), (Y-35), (Y-36), (Y-37), (Y-38) and (Y-39).

Other examples thereof include compounds (Y-1) to (Y-33) described in said U.S. Pat. No. 4,623,616 (column 19 to 24). Among them, there are preferred (Y-2), (Y-7), (Y-8), (Y-12), (Y-20), (Y-21), (Y 23) and (Y-29).

Other preferred examples of the yellow couplers include compound (34) described in U.S. Pat. No. 3,408,194 (column 6), compounds (16) and (19) described in U.S. Pat. No. 3,933,501 (column 8), compound (9) described in U.S. Pat. No. 4,046,575 (column 7 to 8), compound (1) described in U.S. Pat. No. 4,133,958 (column 5 to 6), compound (1) described in U.S. Pat. No. 4,401,752 (column 5) and the following compounds (a) to (h).

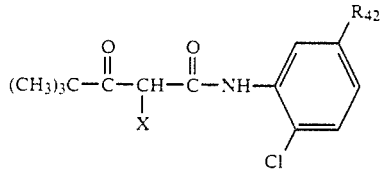

| Compound | $R_{42}$ | X |
|---|---|---|
| a | $-COOCH(CH_3)COOC_{12}H_{25}$ | 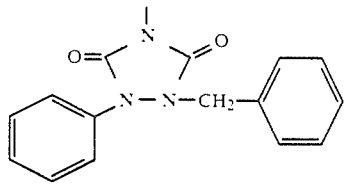 |
| b | $-COOCH(C_4H_9)COOC_{12}H_{25}$ | " |
| c | 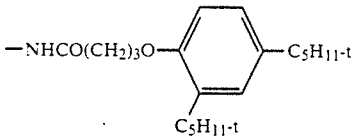 | 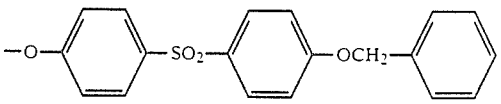 |
| d | 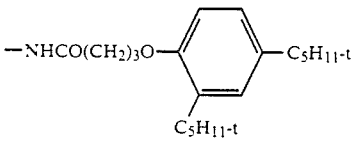 | 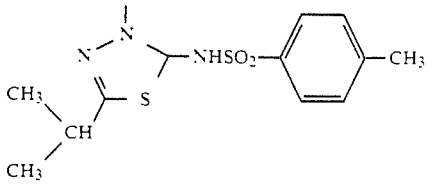 |

-continued

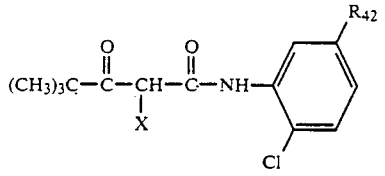

| Compound | $R_{42}$ | X |
|---|---|---|
| e | 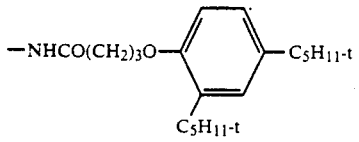 | 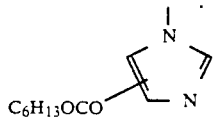 |
| f | $-NHSO_2C_{12}H_{25}$ | 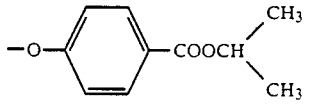 |
| g | $-NHSO_2C_{16}H_{33}$ | 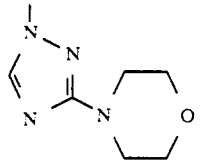 |
| h | 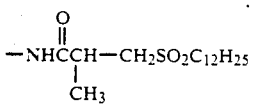 | 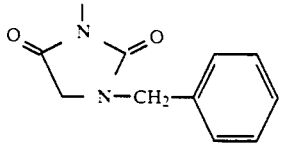 |

Among above couplers, the compounds where elimination atom is nitrogen atom are particularly preferred.

Most typical examples of cyan couplers are phenol cyan couplers and naphthol cyan couplers.

Examples of the cyan couplers include compounds having an acylamino group at the 2-position of the phenol nucleus and an alkyl group at the 5-position of the phenol nucleus (including polymer couplers) described in U.S. Pat. Nos. 2,369,929, 4,518,687, 4,511,647 and 3,772,002. Typical examples thereof include coupler described in Example 2 of Canadian Patent 625,822, compound (1) described in U.S. Pat. No. 3,772,002, compounds (I-4) and (I-5) described in U.S. Pat. No. 4,564,590, compounds (1), (2), (3) and (24) described in JP-A-61-39045 and compound (C-2) described in JP-A-62-70846.

Other examples of the phenol cyan couplers include 2,3-diacylaminophenol couplers described in U.S. Pat. Nos. 2,772,162, 2,895,826, 4,334,011 and 4,500,653 and JP-A-59-164555. Typical examples thereof include compound (V) described in U.S. Pat. No. 2,895,826, compound (17) described in U.S. Pat. No. 4,557,999, compounds (2) and (12) described in U.S. Pat. No. 4,565,777, compound (4) described in U.S. Pat. No. 4,124,396 and compound (I-19) described in U.S. Pat. No. 4,613,564.

Other examples of the phenol cyan couplers include compounds where nitrogen-containing heterocyclic ring is condensed with phenol nucleus described in U.S. Pat. Nos. 4,372,173, 4,564,586 and 4,430,423, JP-A-61-390441 and JP-A-62-257158. Typical examples thereof include couplers (1) and (3) described in U.S. Pat. No. 4,327,173, compounds (3) and (16) described in U.S. Pat. No. 4,564,586, compounds (1) and (3) described in U.S. Pat. No. 4,430,423 and the following compounds.

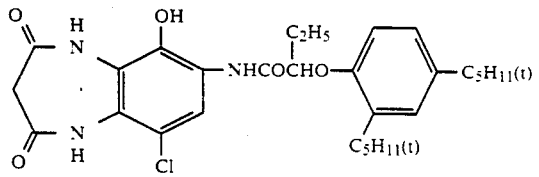

-continued
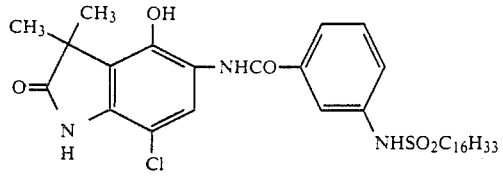
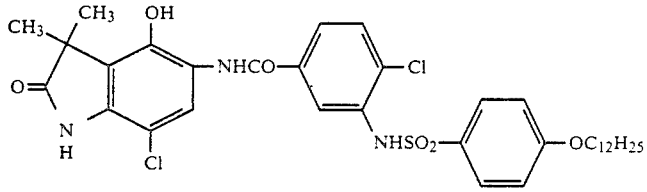
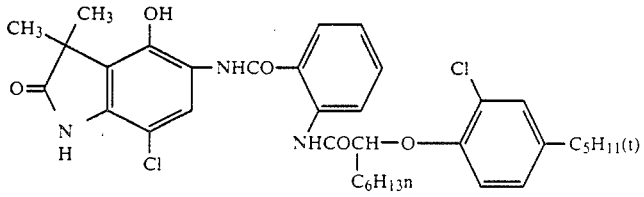
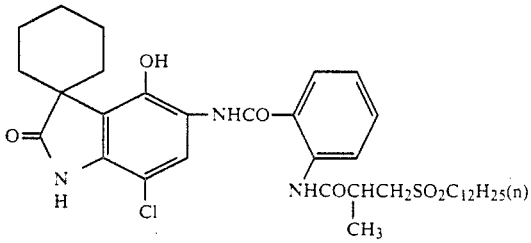
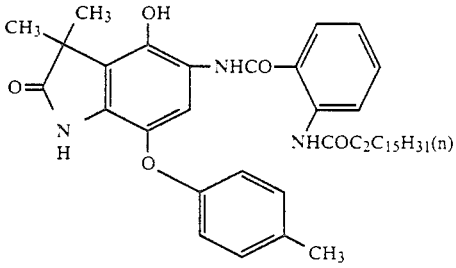
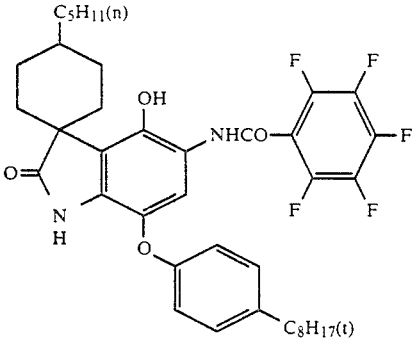
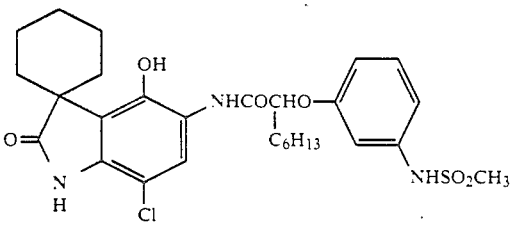

In addition to the above couplers, the following diphenylimidazole couplers described in European Patent Laid-Open No. EPO 249,453A2 can be used.

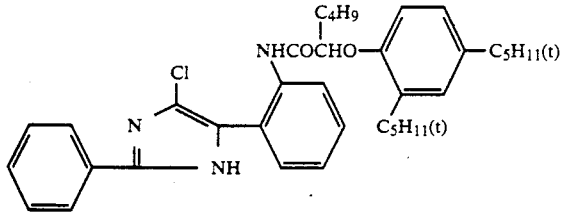

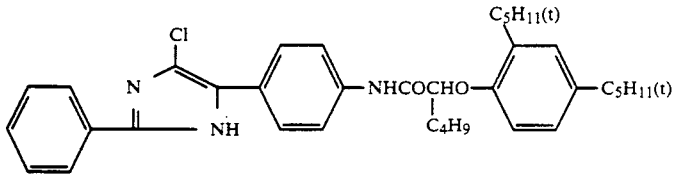

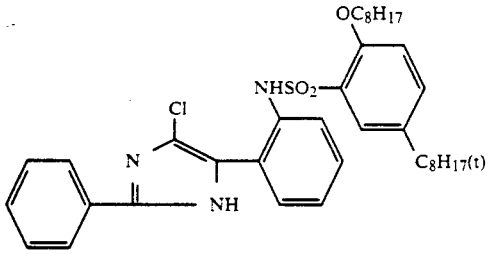

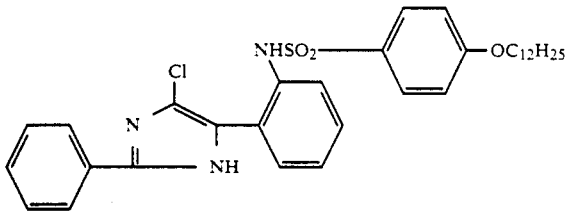

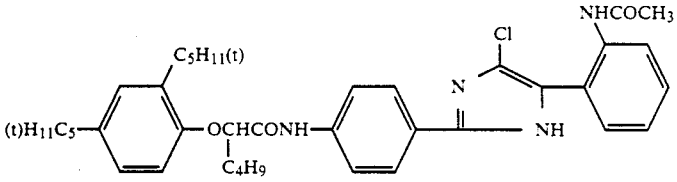

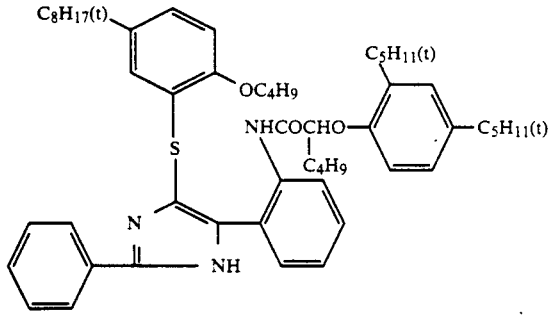

Other examples of the phenol cyan couplers include ureido couplers described in U.S. Pat. Nos. 4,333,999, 4,451,559, 4,444,872, 4,427,767 and 4,579,813 and EP-$B_1$-067,688. Typical examples thereof include coupler (7) described in U.S. Pat. No. 4,333,999, coupler (1) described in U.S. Pat. No. 4,451,559, coupler (14) described in U.S. Pat. No. 4,444,872, coupler (3) described in U.S. Pat. No. 4,427,767; couplers (6) and (24) described in U.S. Pat. No. 4,609,619, couplers (1) and (11) described in U.S. Pat. No. 4,579,813, couplers (45) and (50) described in EP-$B_1$-067,689 and coupler (3) described in JP-A-61-42658.

Examples of the naphthol cyan couplers include compounds having an N-alkyl-N-arylcarbamoyl group at the 2-position of naphthol nucleus (e.g., described in U.S. Pat. No. 2,313,586), compounds having an alkylcarbamoyl group at the 2-position (e.g., described in U.S. Pat. Nos. 2,474,293 and 4,282,312), compounds having an arylcarbamoyl group at the 2-position (e.g., described in JP-B-50-14523), compounds having a carbonamido group or a sulfonamide group at the 5-position (e.g., described in JP-A-60-237448, JP-A-61-145557, JP-A-153640), compounds having an aryloxy elimination group (e.g., described in U.S. Pat. No. 3,476,563, compounds having a substituted alkoxy elimination group (e.g., described in U.S. Pat. No. 4,296,199) and compounds having a glycolic acid elimination group (e.g., JP-B-60-39217).

Emulsified dispersions containing these yellow couplers or cyan couplers can be prepared according to the methods described in U.S. Pat. Nos. 2,322,027, 2,533,514 and 2,801,171. These emulsified dispersions have a mean grain size of preferably not larger than 0.5 μm, more preferably not larger than 0.3 μm, most preferably not larger than 0.2 μm.

Each of these magenta, yellow and cyan couplers together with at least one high boiling organic solvent is dispersed and incorporated in emulsion layers. Preferably, the pyrazoloazole type magenta coupler of the present invention is dispersed in a high-boiling organic solvent having a dielectric constant of from 5.3 to 6.7 to attain the objects of the present invention. The high-boiling organic solvents may be used as a mixture of two or more of them, so long as the mixture has a dielectric constant of from 5.3 to 6.7. In the present invention, the dielectric constant is a value measured at 30° C. Preferably, high-boiling organic solvents represented by the following formulas (A) to (E) are used.

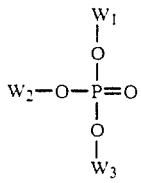
(A)

$W_1-COO-W_2$ (B)

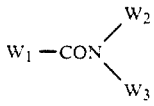
(C)

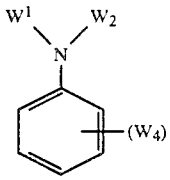
(D)

$W_1-O-W_2$ (E)

In the above formulas, $W_1$, $W_2$ and $W_3$ are each a substituted or unsubstituted alkyl, cycloalkyl, alkenyl, aryl or heterocyclic group; $W_4$ is $W_1$, $OW_1$ or $SW_1$; and n is an integer of from 1 to 5. When n is 2 or greater, $W_4$ may be the same or different groups. In the formula (E), $W_1$ and $W_2$ may be combined together to form a condensed ring.

These solvents are described in more detail in JP-A-62-215272 (pages 137 to 144).

Example of the hi9h-boiling organic solvents which can be used in the present invention include, but are not limited to, the following compounds.

$O=P(OC_4H_{9}\text{-}n)_3$ (S-1)

$O=P(OCH_2CH_2CH(CH_3)CH_3)_3$ (S-2)

$O=P(OC_6H_{13}\text{-}n)_3$ (S-3)

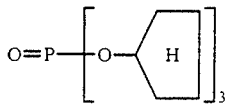
(S-4)

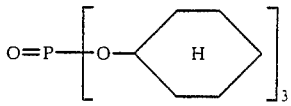
(S-5)

$O=P(OC_9H_{17}\text{-}n)_3$ (S-6)

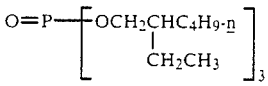
(S-7)

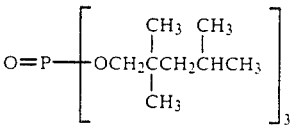
(S-8)

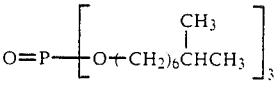
(S-9)

$O=P(OC_9H_{19}\text{-}n)_3$ (S-10)

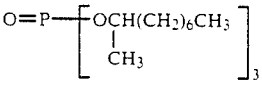
(S-11)

$O=P(OC_{10}H_{21}\text{-}n)_3$ (S-12)

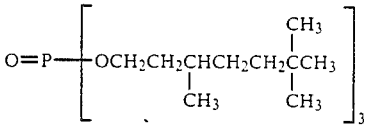
(S-13)

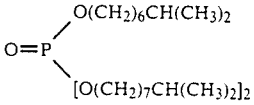
(S-14)

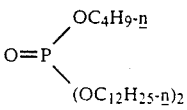
(S-15)

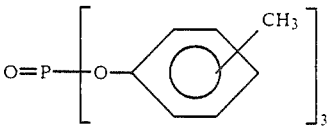
(S-16)

-continued
(S-17)
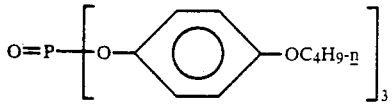
(S-18)
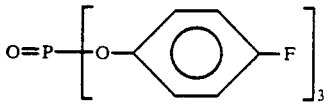
(S-19)
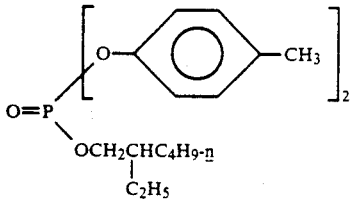
(S-20)
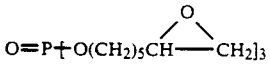
(S-21)
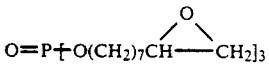
(S-22)
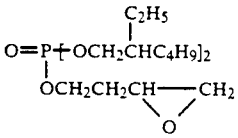
(S-23)
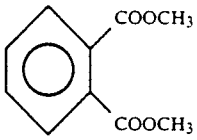
(S-24)
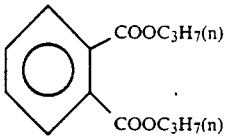
(S-25)
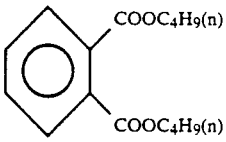
(S-26)
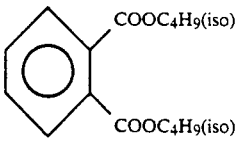
(S-27)
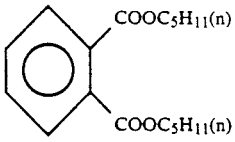
-continued
(S-28)
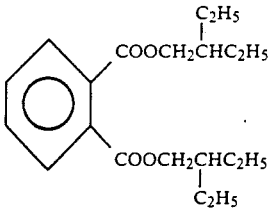
(S-29)
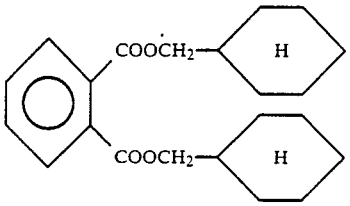
(S-30)
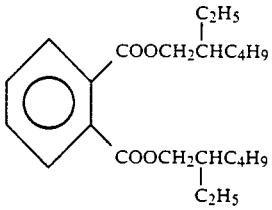
(S-31)
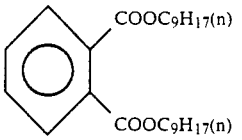
(S-32)
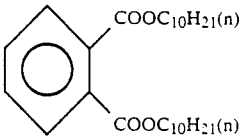
(S-33)
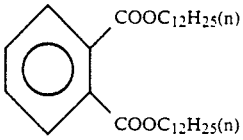
(S-34)
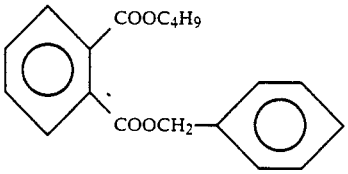
(S-35)
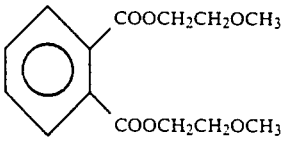
(S-36)
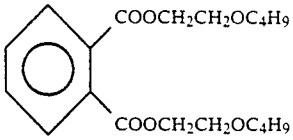

-continued
(S-37)
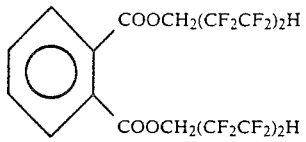
(S-38)
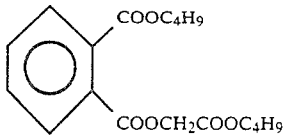
(S-39)
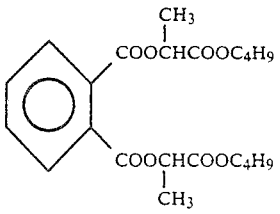
(S-40)
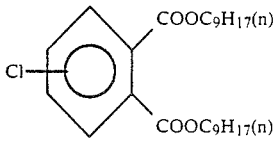
(S-41)
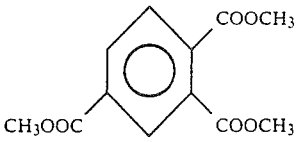
(S-42)
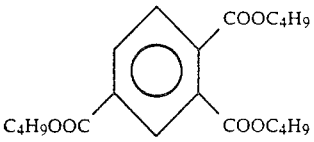
(S-43)
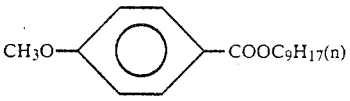
(S-44)
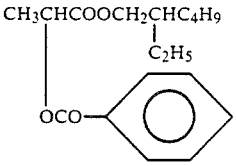
(S-45)
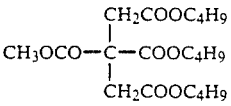
(S-46)
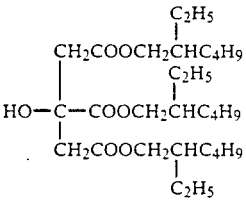
-continued
(S-47)
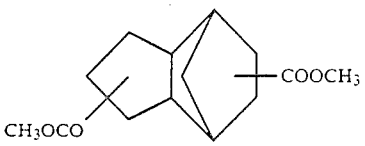
(S-48)
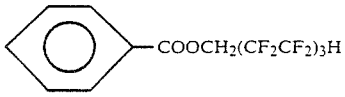
(S-49)
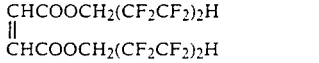
(S-50)
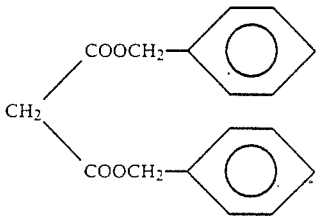
(S-51)
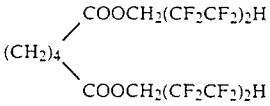
(S-52)
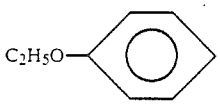
(S-53)
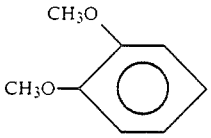
(S-54)
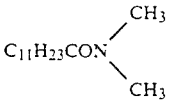
$C_{12}H_{25}OH$ (S-55)
$C_{16}H_{33}OH$ (S-56)
$C_{19}H_{37}OH$ (S-57)
$C_{10}H_{21}O(CH_2)_5O(CH_2)_2OH$ (S-58)
(S-59)
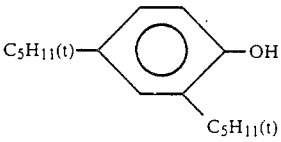
(S-60)
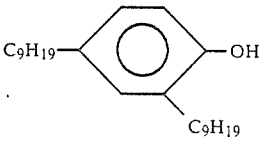
$CH_3(CH_2)_{17}Cl$ (S-61)
$CH_3(CH_2)_{15}Br$ (S-62)

-continued (S-63)

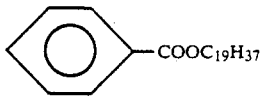

(S-64)

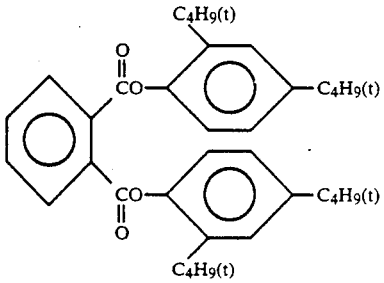

(S-65)

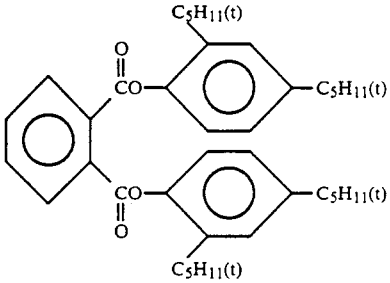

(S-66)

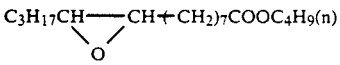

(S-67)

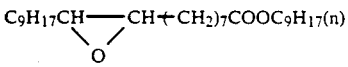

(S-68)

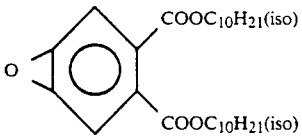

(S-69)

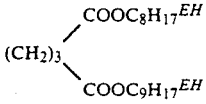

(S-70)

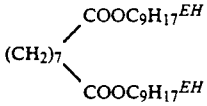

("$-C_8H_{17}^{EH}$" represents "$-CH(C_2H_5)(CH_2)_4CH_3$".)

These magenta, yellow and cyan couplers are impregnated with latex polymer (e.g., latex polymer described in U.S. Pat. No. 4,203,716) in the presence or absence of said high-boiling organic solvent, or dissolved in a water-insoluble, but organic solvent soluble polymer and can be emulsified and dispersed in an aqueous solution of hydrophilic colloid.

Preferably, homopolymers or copolymers described in WO 88/00723 (pages 12 to 30) are used. Particularly, acrylamide polymers are preferred from the viewpoint of dye image stability.

The photographic materials prepared by the present invention may contain hydroquinone derivatives, aminophenol derivatives, gallic acid derivatives and ascorbic acid derivatives as color fogging inhibitors (antifogging agents).

The photographic materials of the present invention may contain various anti-fading agents. Examples of the anti-fading agents for cyan, magenta and/or yellow images include hydroquinones, 6-hydroxychromans, 5-hydroxycoumarans, spiro-chromans, p-alkoxyphenols, hindered phenols such as bisphenols, gallic acid derivatives, methylenedioxybenzenes, aminophenols, hindered amines and ethers or ester derivatives obtained by silylating or alkylating phenolic hydroxyl group of the above-described compounds. Further, metal complexes such as (bissalicyl-aldoximato)nickel complex and (bis-N,N-dialkyldithiocarbamato)nickel can also be used.

Examples of the organic anti-fading agents includes hydroquinones described in U.S. Pat. Nos. 2,360,290, 2,418,613, 2,700,453, 2,701,197, 2,728,659, 2,732,300, 2,735,765, 3,982,944 and 4,430,425, U.K. Patent 1,363,921, U.S. Pat. Nos. 2,710,801 and 2,816,028; 6-hydroxychromans, 5-hydroxycoumarans and spirochromans described in U.S. Pat. Nos. 3,432,300, 3,573,050, 3,574,627, 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B 57-19765; hindered phenols described in U.S. Pat. Nos. 3,700,455 and 4,228,235, JP-A-52-72224 and JP-B 52-6623; gallic acid derivatives, methylenedioxybenzenes and aminophenols described in U.S. Pat. Nos. 3,457,079 and 4,332,886 and JP-B-56-21144; hindered amines described in U.S. Pat. Nos. 3,336,135 and 4,268,593, U.K. Patents 1,326,889, 1,354,313 and 1,410,846, JP-B-51-1420, JP-A-58-114036, JP-A-59-53846 and JP-A-59-78344; ether and ester derivatives of phenolic hydroxyl group described in U.S. Pat. Nos. 4,155,765, 4,174,220, 4,254,216 and 4,264,720, JP-A-54-145530, JP-A-55-6321, JP-A-58-105147, JP-A 59-10539, JP-B-57-37856, U.S. Patent 4,279,990 and JP-B-53-3263; and metal complexes described in U.S. Pat. Nos. 4,050,938 and 4,241,153 and U.K. Patent 2,027,731 (A). These compounds are used in an amount of generally 5 to 100% by weight based on the amount of the corresponding coupler. These compounds are co-emulsified with the couplers and added to the emulsion layers. It is preferred that an ultraviolet light absorbing agent is introduced into both layers adjacent to the cyan color forming layer to prevent cyan color image from being deteriorated by heat and particularly light.

Among said anti-fading agents, spiro-indanes and hindered amines are particularly preferred.

The hydrophilic colloid layers of the photographic materials of the present invention may contain ultraviolet light absorbing agents. Examples of the ultraviolet light absorbing agents include aryl group-substituted benztriazole compounds described in U.S. Pat. No. 3,533,794; 4-thiazolidone compounds described in U.S. Pat. Nos. 3,314,794 and 3,352,681; benzophenone compounds described in JP-A-46-2784; sinnamic ester compounds described in U.S. Pat. Nos. 3,705,805 and 3,707,375; butadiene compounds described in U.S. Pat. No. 4,045,229; and benzoccidol compounds described in U.S. Pat. No. 3,700,455. If desired, ultraviolet absorbing couplers (e.g., α-naphthol cyan color forming couplers) and ultraviolet light absorbing polymers may be used. These ultraviolet light absorbers may be mordanted in specific layers.

The hydrophilic colloid layers of the photographic materials may contain water-soluble dyes as filter dyes or for the purpose of preventing irradiation. Examples of the dyes include oxonol dyes, hemioxonol dyes, styryl dyes, merocyanine dyes, cyanine dyes and azo dyes. Among them, oxonol dyes, hemioxonol dyes and merocyanine dyes are preferred.

Gelatin is preferred as a binder or protective colloid for the emulsion layers of the photographic materials of the present invention. In addition thereto, hydrophilic colloid alone or in combination with gelatin can be used.

Any of lime-processed gelatin and acid-processed gelatin can be used. The preparation of gelatin is described in more detail in Arthur, Weiss, The Macromelecular Chemistry of gelatin (Academic Press 1964).

Any of transparent films such as cellulose nitrate film and polyethylene terephthalate film and reflection type support can be used as supports in the present invention. For the purpose of the present invention, the reflection type support is preferable.

The term "reflection type support" as used herein refers to supports which enhance reflection properties to make a dye image formed on the silver halide emulsion layer clear. Examples of the reflection type support include supports coated with a hydrophobic resin containing a light reflecting material such as titanium oxide, zinc oxide, calcium carbonate or calcium sulfate dispersed therein and supports composed of a hydrophobic resin containing a light reflecting material dispersed therein. Typical examples of the supports include baryta paper, polyethylene coated paper, polypropylene synthetic paper, transparent supports coated with a reflecting layer or containing a reflection material, glass sheet, polyester film such as polyethylene terephthalate film and cellulose triacetate, polyamide films, polycarbonate films, polystyrene films and vinyl chloride resins. These supports can be properly chosen according to the purpose of use.

It is preferred that as the reflecting material, a white pigment is thoroughly kneaded in the presence of a surfactant or the surfaces of pigment particles are treated with a dihydric to tetrahydric alcohol.

The occupied area ratio (%) of fine particles of white pigment per unit area can be determined by dividing the observed area into adjoining unit area of 6 $\mu m \times 6$ $\mu m$ and measuring the occupied area ratio (%) (Ri) of the fine particles projected on the unit area. A coefficient of variation of the occupied area ratio (%) can be determined from a ratio ($S/\bar{R}$) of standard deviation S of Ri to the mean value ($\bar{R}$) of Ri. The number (n) of divided unit areas is preferably not less than 6. Accordingly, a coefficient of variation $S/\bar{R}$ can be determined by the following formula.

$$\sqrt{\frac{\sum_{l=1}^{n} (Ri - \bar{R})^2}{n-1}} \Big/ \frac{\sum_{l=1}^{n} Ri}{n}$$

In the present invention, a coefficient of variation of the occupied area ratio (%) of the fine pigment particles is preferably not more than 0.15, particularly not more than 0.12. When the value is not more than 0.08, it is considered that the dispersion of the particles is substantially uniform.

It is preferred that the color photographic materials of the present invention are subjected to color development, bleaching-fixing and rinsing treatment (or stabilizing treatment). Bleaching and fixing may be carried out with one bath or separately.

When continuous processing is conducted, less rate of replenishment is preferred from the viewpoint of resource saving and low-level pollution.

The replenishment rate of the color developing solution is preferably not more than 200 ml, more preferably not more than 120 ml, still more preferably not more than 100 ml per $m^2$ of the photographic material. The term "replenishment rate" as used herein means an amount of the color developing solution to be replenished, exclusive of the amounts of additives for the replenishment of amounts lost by condensation or deteriorated with time. Said additives mean water for dilution of condensate, preservative which is liable to be deteriorated with time, an alkaline agent for raising pH, etc.

The color developing solutions which can be used in the present invention are preferably aqueous alkaline solutions mainly composed of aromatic primary amine color developing agents. Aminophenol compounds are useful as the color developing agents and p-phenylenediamine compounds are preferred as the color developing agents. Typical examples thereof include 3-methyl-4-amino-N,N-diethylaniline, 3-methyl-4-amino-N-ethyl-N-$\beta$-hydroxyethylaniline, 3-methyl-4-amino N-ethyl-N-$\beta$-methanesulfonamidoethylaniline, 3-methyl-4-amino-N-ethyl-N-$\beta$-methoxyethylaniline and salts thereof such as sulfate, hydrochloride and p-toluenesulfonate.

These compounds may be used either alone or in combination of two or more of them.

Generally, the color developing solutions contain pH buffering agents such as alkali metal carbonates, borates and phosphates, restrainers such as bromides, iodides, benzimidazoles, benzothiazoles and mercapto compounds and anti-fogging agents. If desired, the color developing solutions may optionally contain organic solvents such as ethylene glycol and diethylene glycol; development accelerators such as benzyl alcohol, polyethylene glycol, quaternary ammonium salts and amines; fogging agents such as color forming couplers, competive couplers and sodium boron hydride; auxiliary developing agents such as 1-phenyl-3-pyrazolidone; tackifiers; and chelating agents such as polyaminocarboxylic acids, polyaminophosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development is first carried out and color development is then carried out. Black-and-white developing solutions may contain conventional developing agents such as dihydrobenzenes (e.g., hydroquinone), 3-pyrazolidones (e.g., 1-phenyl-3-pyrazolidone) and aminophenols (e.g., N-methyl-p-aminophenol). These developing agents may be used either alone or in combination of two or more of them.

The pH of the color developing solutions and the black-and-white developing solutions is generally in the range of 9 to 12. The replenishment rate of these developing solutions varies depending on the types of the color photographic materials, but is usually not more than 3 l per $m^2$ of the photographic material. The replenishment rate can be reduced to 500 ml or less when the concentration of bromide ion in the replenisher is reduced. When the replenishment is to be reduced, it is desirable that the contact area of the layer to be processed, with air is reduced to prevent the solution from being evaporated or oxidized by air. The replenishment rate can be reduced by using a means for inhibiting the accumulation of bromide ion in the developing solution.

After color development, the photographic emulsion layer is generally bleached. Bleaching may be carried out simultaneously with fixing (bleaching-fixing treatment) and they are separately carried out. After bleaching, a bleaching-fixing treatment may be conducted to expedite processing. Treatment may be conducted with a bleaching-fixing bath composed of two consecutive tanks. Fixing may be conducted before the bleaching-fixing treatment. After the bleaching-fixing treatment, bleaching may be conducted according to purpose. Examples of bleaching agents include compounds of polyvalent metals such as iron(III), cobalt(III), chromium(VI) and copper(II), peracids, quinones and nitro compounds. Typical examples of the bleaching agents include ferricyanates; dichromates; organic complex salts of iron(III) and cobalt(III) such as complex salts of polyaminocarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.) citric acid, tartaric acid, malic acid, etc.; persulfates; bromates; permanganates; and nitrobenzenes. Among them, ion(III) complex salts of polyaminocarboxylic acids such as (ethylenediaminetetraacetonato)iron(III) complex and persulfates are preferred from the viewpoints of rapid processing and prevention of environmental pollution. Further, iron(III) complex salts of polyaminocarboxylic acids are useful for bleaching solutions and bleaching-fixing solutions. The pH of the bleaching solutions containing the iron(III) complex salts of the polyaminocarboxylic acids and the bleaching-fixing solutions containing said iron(III) complex salts is generally in the range of 5.5 to 8. Lower pH may be used to expedite processing.

If desired, the bleaching solution, the bleaching-fixing solution and the previous bath thereof may contain bleaching accelerators. Examples of the bleaching accelerators include compounds having mercapto group or disulfide group described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP A-49-42434, JP-A-49-59644, JP-A-53-94927, JP-A-54-35727, JP-A-55-26506 and JP-A-58-163940; and bromide ions. Among them, the compounds having mercapto group or disulfide group are preferred from the viewpoint of high accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated in the photographic materials. These bleaching accelerators are particularly effective in conducting the bleaching-fixing of the color photographic materials for photographing.

Examples of fixing agents include thiosulfates, thiocyanates, thioether compounds, thioureas and various iodides. The thiosulfates are widely used as the fixing agents. Particularly, ammonium thiosulfate is most widely used. Sulfites, bisulfites and carbonyl bisulfite fite adducts are preferred as preservatives for the bleaching-fixing solutions.

Usually, the silver halide color photographic materials of the present invention are subjected to washing and/or stabilization stage after desilverization. The amount of rinsing water in the washing stage widely varies depending on the characteristics (e.g., depending on materials used such as couplers) of the photographic materials, use, the temperature of rinsing water, the number of rinsing tanks (the number of stages), replenishing system (countercurrent, direct flow) and other conditions. The relationship between the amount of water and the number of rinsing tanks in the multi-stage countercurrent system can be determined by the method described in *Journal of the Society of Motion Picture and Television Engineers,* Vol. 64, p. 248-253 (May 1955).

According to the multi-stage countercurrent system described in the above literature, the amount of rinsing water can be greatly reduced. However, there is caused a problem that the residence time of water in the tanks is prolonged and as a result, bacteria are grown and the resulting suspended matter is deposited on the photographic material. A method for reducing calcium ion and magnesium ion described in Japanese Patent Application No. 61-131632 can be effectively used for the color photographic materials of the present invention to solve the above-mentioned problem. Further, isothiazolone compounds, thiabendazole compounds, chlorine-containing germicides such as sodium chlorinated isocyanurate and benztriazole described in JP-A-57-8542 and germicides described in *Chemistry of Germicidal Antifungal Agent,* written by Hiroshi Horiguchi, *Sterilization, Disinfection, Antifungal Technique,* edited by Sanitary Technique Society and *Antibacterial and Antifungal cyclopedie,* edited by Nippon Antibacterial Antifungal Society, can be used.

The pH of rinsing water in the treatment of the photographic materials of the present invention is in the range of 4 to 9, preferably 5 to 9. The temperature of rinsing water and washing time vary depending on the characteristics of the photographic materials, use, etc., but the temperature and time of washing are generally 15° to 45° C. for 20 seconds to 10 minutes, preferably 25° to 40° C. for 30 seconds to 5 minutes. The photographic materials of the present invention may be processed directly with stabilizing solutions in place of said rinsing water. Such stabilizing treatment can be carried out by conventional methods described in JP-A-57-8543, JP-A-58-14834 and JP-A-60-220345.

The stabilizing treatment subsequent to the rinsing may be conducted. The stabilizing treatment may be used as the final bath for the color photographic materials for photographing. An example thereof include a stabilizing bath containing formalin and a surfactant. The stabilizing bath may contain various chelating agents and antifungal agents.

Overflow solution from the replenishment of rinsing water and/or stabilizing can be reused in other stages such as desilverization stage.

The color developing agents may be incorporated in the silver halide color photographic materials of the present invention for the purpose of simplifying and expediting processing. It is preferred that precursors for the color developing agents are used for the incorporation thereof in the photographic materials. Examples of the precursors include indoaniline compounds described in U.S. Pat. No. 3,342,597; Schiff base compounds described in U.S. Pat. No. 3,342,599 *Research Disclosure* No. 14850 and ibid., No. 15159; aldol compounds described in *Research Disclosure* No. 13924; metal complex salts described in U.S. Patent 3,719,492; and urethane compounds described in JP-A 53-135628.

If desired, 1-phenyl 3-pyrazolidones may be incorporated in the silver halide color photographic materials of the present invention for the purpose of accelerating color development. Typical examples of the compounds include those described in JP-A-56-64339, JP-A-57-144547 and JP A-58-115438.

In the present invention, various processing solutions are used at a temperature of 10° to 50° C. Generally, a temperature of 33° to 38° C. is used. However, it is possible that higher temperature is used to accelerate processing and to shorten processing time, while lower temperature is used to improve image quality and to improve the stability .of the processing solutions. If desired, treatments using cobalt intensification or hydrogen peroxide intensification described in West German Patent 2,226,770 and U.S. Pat. No. 3,674,499 may be carried out to save silver.

The excellent characteristics of the silver halide photographic materials of the present invention can be exhibited by carrying out processing with the color developing solutions containing not more than 0.002 mol of bromine ion per liter and substantially no benzyl alcohol for a development time of not longer than 150 seconds.

The term "containing substantially no benzyl alcohol" as used herein means not more than 2 ml, preferably not more than 0.5 ml per liter of the color developing solution. It is most preferred that the developing solutions are completely free from benzyl alcohol.

The present invention is now illustrated in greater detail by reference to the following examples which, however, are not to be construed as limiting the invention in any way.

EXAMPLE 1

Silver halide emulsion (1) for blue-sensitive silver halide emulsion layer was prepared in the following manner.

| | |
|---|---|
| Solution 1 | |
| $H_2O$ | 1000 ml |
| NaCl | 8.8 g |
| Gelatin | 25 g |
| Solution 2 | |
| Sulfuric acid (1N) | 20 ml |
| Solution 3 | |
| The following compound (1%) | 3 ml |

-continued

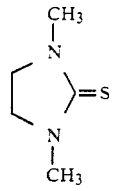

| | |
|---|---|
| Solution 4 | |
| KBr | 14.01 g |
| NaCl | 1.72 g |
| Add $H_2O$ | 130 ml |
| Solution 5 | |
| $AgNO_3$ | 25 g |
| Add $H_2O$ | 130 ml |
| Solution 6 | |
| KBr | 56.03 g |
| NaCl | 6.88 g |
| $K_2IrCl_6$ (0.001%) | 1.0 ml |
| Add $H_2O$ | 285 ml |
| Solution 7 | |
| $AgNO_3$ | 100 g |
| $NH_4NO_3$ (50%) | 2 ml |
| Add $H_2O$ | 285 ml |

The solution 1 was heated to 75° C. The solution 2 and the solution 3 were added thereto. Subsequently, the solution 4 and the solution 5 were simultaneously added thereto over a period of 40 minutes. After 10 minutes, the solution 6 and the solution 7 were simultaneously added thereto over a period of 25 minutes. After 5 minutes from the completion of the addition, the temperature of the mixture was lowered and the mixture was desalted. Water and dispersion gelatin were added thereto. The pH of the mixture was adjusted to 6.2, thus obtaining a monodisperse cubic silver chlorobromide emulsion (1) having a silver bromide content of 80 mol %, a mean grain size of 1.01 μm and a variation coefficient (a value $S/\bar{d}$ obtained by dividing standard deviation by mean grain size) of 0.08. The emulsion was properly chemical-sensitized with triethylthiourea.

Silver halide emulsion (2) for blue-sensitive silver halide emulsion layer, silver halide emulsions (3), (4), (7) and (8) for green-sensitive silver halide emulsion layers and silver halide emulsions (5) and (6) for red-sensitive silver halide emulsion layers were prepared in the same manner as in the preparation of the emulsion (1) except that the amounts of reagents, temperature and addition time were changed.

The shape, mean grain size, halogen composition and variation coefficient of each of the silver halide emulsions (1) to (8) are given in the following Table.

The iridium ion content of the silver halide emulsions (3) to (8) was $1\times10^{-8}$ mol per mol of silver.

| Shape of Emulsion | Mean Grain Size (μm) | Halogen Composition (Br mol %) | Coefficient of Variation |
|---|---|---|---|
| (1) cube | 1.01 | 80 | 0.08 |
| (2) cube | 0.70 | 80 | 0.07 |
| (3) cube | 0.52 | 70 | 0.08 |
| (4) cube | 0.40 | 70 | 0.09 |
| (5) cube | 0.44 | 70 | 0.09 |
| (6) cube | 0.36 | 70 | 0.08 |
| (7) cube | 0.53 | 90 | 0.08 |
| (8) cube | 0.41 | 90 | 0.09 |

A paper support (both sides thereof being laminated with polyethylene) was coated with the following layers to prepare a multi-layer color photographic material (A-1) having the following layer structure. Coating solutions were prepared in the following manner.

Preparation of Coating Solution for First Layer 19.1 g of yellow coupler ($ExY_1$), 0.17 g of anti-fogging agent (Cpd-1) and 1.91 g of dye image stabilizer (Cpd-2) were dissolved in 27.2 cc of ethyl acetate, 3.8 cc of solvent (Solv-1) and 3.8 cc of solvent (Solv-2). The resulting solution was emulsified and dispersed in 185 cc of a 10% aqueous gelatin solution containing 8 cc of 10% sodium dodecylbenzenesulfonate. Separately, $5.0\times10^{-4}$ mol of the following blue sensitive sensitizing dye per mol of silver was added to a 3:7 mixture of the silver halide emulsion (1) and the silver halide emulsion (2) to prepare an emulsion. Said emulsion and the above emulsified dispersion were mixed and dissolved. A coating solution for first layer was prepared so as to give the following composition.

Coating solutions for the second to seventh layers were prepared in the same manner as in the preparation of the coating solution for the first layer.

Sodium salt of 1-oxy-3,5-dichloro-s-triazine was used as the hardening agent for gelatin in each layer.

The following spectral sensitizing dyes for the following layers were used.

Blue-sensitive Emulsion Layer

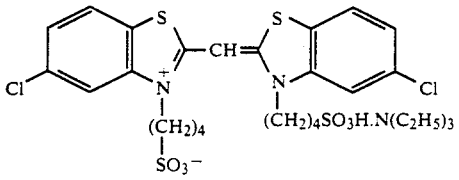

($5.0\times10^{-4}$ mol per mol of emulsion)

Green-sensitive Emulsion Layer

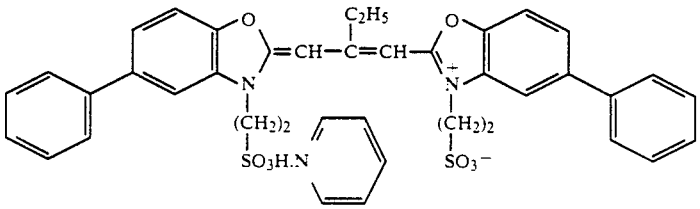

($4.0\times10^{-4}$ mol per mol of emulsion)

and

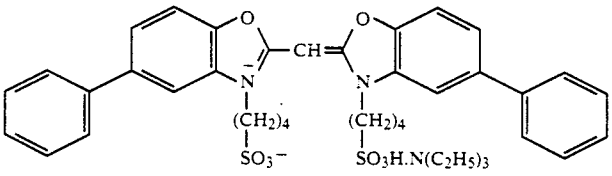

($7.0\times10^{-5}$ mol per mol of emulsion)

Red-sensitive Emulsion Layer

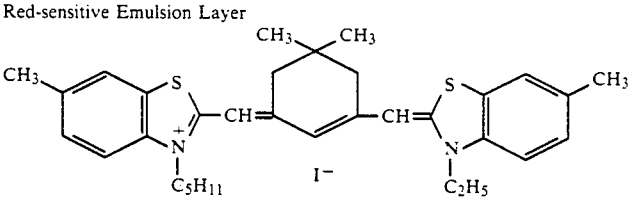

($5.5\times10^{-5}$ mol per mol of emulsion)

$2.6\times10^{-3}$ mol of the following compound per mol of silver halide was added to the red-sensitive emulsion layer.

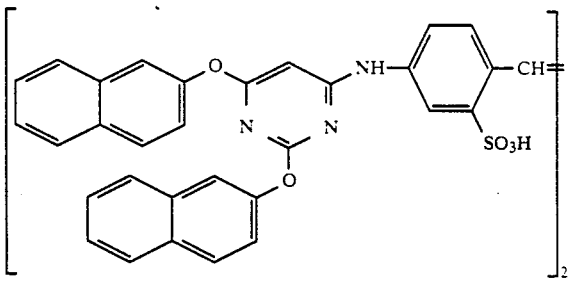

$1.2\times10^{-2}$ mol and $1.1\times10^{-2}$ mol of 4-hydroxy-6-methyl-1,3,3a,7-tetraazaindene per mol of silver halide were added to the blue-sensitive emulsion layer and the green-sensitive emulsion layer, respectively.

The following dye was used as the irradiation-preventing dye.

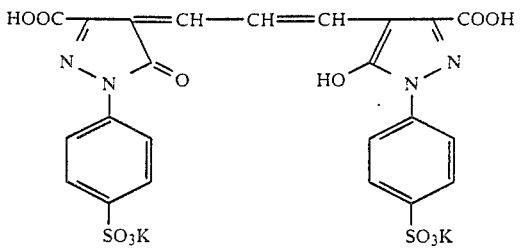

and

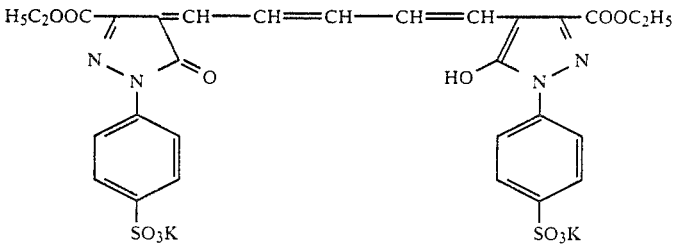

Layer Structure

Each layer had the following composition. Numerals represent coating weight (g/m$^2$). The amounts of the silver halide emulsions are represented by coating weight in terms of silver.

Support

Paper support (both sides thereof being laminated with polyethylene)

[Polyethylene on the side of the first layer contained white pigment ($TiO_2$) and bluish dye (ultramarine)].

| | |
|---|---|
| First Layer: Blue-sensitive Layer | |
| Silver halide emulsions (1) + (2) | 0.29 |
| Gelatin | 1.23 |
| Yellow coupler ($ExY_1$) | 0.65 |
| Anti fogging agent (Cpd-1) | 0.006 |
| Dye image stabilizer (Cpd-2) | 0.07 |
| Solvent (Solv-1) | 0.12 |
| Solvent (Solv-2) | 0.12 |
| Second Layer: Color Mixing Inhibiting Layer | |
| Gelatin | 1.34 |
| Color mixing Inhibitor (Cpd-3) | 0.04 |
| Solvent (Solv-3) | 0.09 |
| Solvent (Solv-4) | 0.09 |
| Third Layer: Green-sensitive Layer | |
| Silver halide emulsions (3) + (4) | 0.13 |
| Gelatin | 1.67 |

-continued

| | |
|---|---|
| Magenta coupler (I-5) | 0.34 |
| Dye image stabilizer (Cpd-3a) | 0.20 |
| Dye image stabilizer (Cpd-3b) | 0.01 |
| Solvent (Solv-3) | 0.27 |
| Solvent (Solv-5) | 0.42 |
| Fourth Layer: Ultraviolet Light Absorbing Layer | |
| Gelatin | 1.43 |
| Ultraviolet light absorber (UV-1) | 0.47 |
| Color mixing inhibitor (Cpd-3) | 0.05 |
| Solvent (Solv-6) | 0.24 |
| Fifth Layer: Red-sensitive Layer | |
| Silver halide emulsions (5) + (6) | 0.23 |
| Gelatin | 1.03 |
| Cyan coupler (ExC-1) | 0.15 |
| Cyan coupler (ExC-2) | 0.18 |
| Dye image stabilizer (Cpd-2) | 0.30 |
| Anti-fogging agent (Cpd-1) | 0.01 |
| Dye image stabilizer (Cpd-4) | 0.08 |
| Solvent (Solv-1) | 0.20 |
| Sixth Layer: Ultraviolet Light Absorbing Layer | |
| Gelatin | 0.47 |
| Ultraviolet light absorber (UV-1) | 0.16 |
| Solvent (Solv-6) | 0.08 |
| Seventh Layer: Protective Layer | |
| Gelatin | 1.25 |
| Acrylic-modified copolymer of polyvinyl alcohol (degree of modification: 17%) | 0.05 |
| Liquid paraffin | 0.02 |

Yellow Coupler ($ExY_1$)

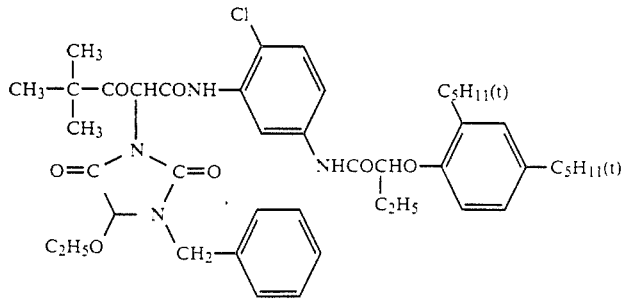

Cyan Coupler ($ExC_1$-1)

-continued
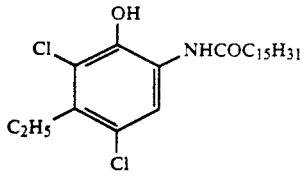
Cyan Coupler (ExC1-2)
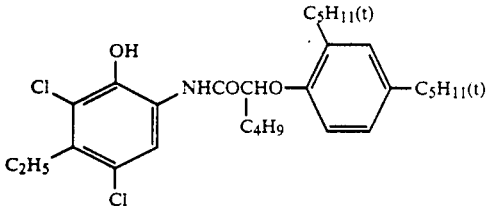
Anti-fogging Agent (Cpd-1)
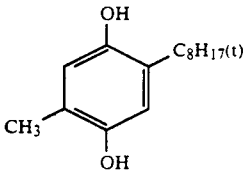
Dye image stabilizer (Cpd-2)
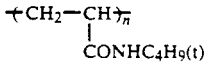
Average Molecular Weight: 60,000
Color mixing inhibitor (Cpd-3)
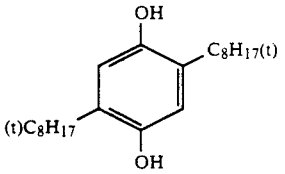
Dye image stabilizer (Cpd-3a)
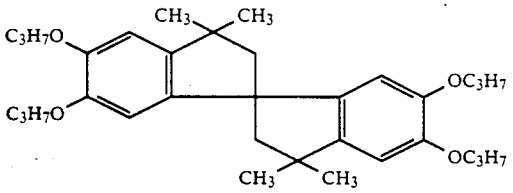
Dye image stabilizer (Cpd-3b)
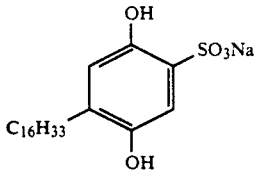
Dye image stabilizer (Cpd-4)
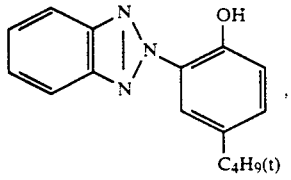

-continued
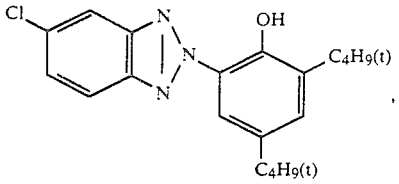
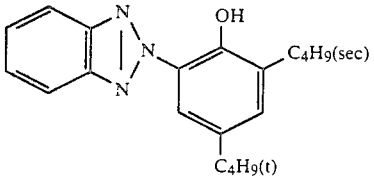
4:2:5 mixture (by weight)
Ultraviolet light absorber (UV-1)
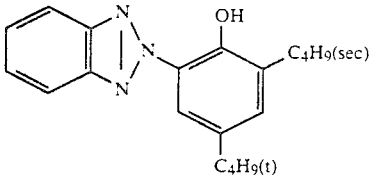
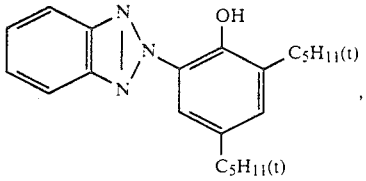
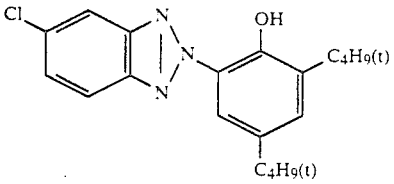
12:10:3 mixture (by weight)
Solvent (Solv-1)
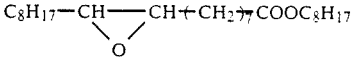
Solvent (Solv-2)
$O{=}P{+}O{-}C_9H_{19}iso)_3$
Solvent (Solv-3)
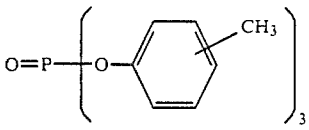
Solvent (Solv-4)
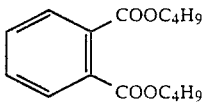
Solvent (Solv-5)
$O{=}P{+}OCH_2\overset{C_2H_5}{\overset{|}{C}}HC_4H_9)_3$
Solvent (Solv-6)

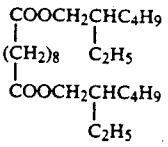

Multi-layer color photographic materials (A-2) to (A-14) were prepared in the same way as in the preparation of the multi-layer color photographic material (A-1) except that the third layer was modified as shown in Table 1.

Besides, the emulsions (7) and (8) were used for the samples (A-13) and (A-14) in place of the emulsions (3) and (4).

With regard to the magenta coupler, an equimolar amount of the coupler was replaced. $4\times10^{-1}$ mol of the compounds (II) or (III) and $1\times10^{-1}$ mol of the compound (V) were added during the preparation of the emulsified dispersion, each amount being per mol of magenta coupler. $8\times10^{-4}$ mol of the compound (IV) per mol of silver was added during the preparation of the coating solution.

TABLE 1

| Sample No. | Magenta Coupler (I) | Compound (II) or (III) | Compound (V) | Compound (IV) |
|---|---|---|---|---|
| A-1 | I-5 | — | — | — |
| A-2 | I-5 | II-31 | — | — |
| A-3 | I-5 | II-31 | V-1 | — |
| A-4 | I-5 | II-31 | — | IV-4 |
| A-5 | I-5 | II-36 | — | IV-4 |
| A-6 | I-5 | II-31 | V-1 | IV-4 |
| A-7 | I-5 | II-48 | V-1 | IV-4 |
| A-8 | I-5 | III-1 | V-6 | IV-4 |
| A-9 | I-5 | II-31 | V-1 | IV-27 |
| A-10 | I-5 | II-31 | V-1 | IV-4 + IV-27 |
| A-11 | I-5 | II-31 | V-1 | IV-6 |
| A-12 | I-5 | II-31 | V-1 | IV-4 |
| A-13 | I-5 | II-31 | V-1 | — |
| A-14 | I-5 | II-31 | V-1 | IV-4 |

Each of the above samples was subjected to gradation exposure for sensitometry through a green filter by using a sensitometer (FWH type, color temperature of light source: 3200° K., manufactured by Fuji Photo Film Co., Ltd.). Exposure time was 0.1 second and exposure was conducted so as to give an exposure amount of 250 CMS.

The samples were then processed in the following color development, bleaching-fixing and rinsing stages.

| Processing Stage | Temperature | Time |
|---|---|---|
| Color development | 33° C. | 3 min 30 sec |
| Bleaching-fixing | 33° C. | 1 min 30 sec |
| Rinsing | 24 to 34° C. | 3 min. |
| Drying | 70 to 80° C. | 1 min. |

| Color Developing Solution | |
|---|---|
| Water | 800 ml |
| Diethylenetriaminepentaacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |

-continued

| | |
|---|---|
| N-Ethyl-N-(β-methanesulfonamidoethyl)-3-methyl-4-aminoaniline sulfate | 5.0 g |
| Hydroxylamine sulfate | 4.0 g |
| Fluorescent brightener (WHITEX 4 B, a product of Sumitomo Chemical Co., Ltd.) | 1.0 g |
| Add water | 1000 ml |
| pH (25° C.) | 10.00, 10.20, 10.40 |
| Bleaching-fixing Solution | |
| Water | 400 ml |
| Ammonium thiosulfate (70%) | 150 ml |
| Sodium sulfite | 18 g |
| Ethylenediaminetetraacetic acid iron(III) ammonium | 55 g |
| Disodium ethylenediaminetetraacetate | 5 g |
| Add water | 1000 ml |
| pH (25° C.) | 6.70 |

After processing was carried out with the color developing solution under two pH conditions of 10.00 and 10.40, optical density was measured through a green filter and there was determined the logarithm of the exposure amount which was required for giving the optical density of 1.0. Processing stability was evaluated by a difference in the logarithm of the exposure amount when processing was carried out under two pH conditions..

The samples was processed with the color developing solution at a pH of 10.20. After one hour from the completion of the processing, the magenta reflection density of non-image area was measured.

Thereafter, the samples were left to stand at 60° C. and 70% RH for 14 days and the magenta reflection density of the non-image area was measured. Further, the samples were left to stand at room temperature for 100 days and the magenta reflection density of the non-image area was again measured. Magenta stain was evaluated by an increase in density after one hour from the completion of the processing.

TABLE 2

| Sample No. | Processing Stability | Magenta Stain 60° C. 70% 14 Days | Magenta Stain Room Temp. 100 Days | Remarks |
|---|---|---|---|---|
| A-1 | 0.15 | 0.15 | 0.13 | Comp. Ex. |
| A-2 | 0.20 | 0.10 | 0.10 | Comp. Ex. |
| A-3 | 0.25 | 0.07 | 0.08 | Comp. Ex. |
| A-4 | 0.07 | 0.05 | 0.04 | Invention |
| A-5 | 0.06 | 0.05 | 0.04 | Invention |
| A-6 | 0.06 | 0.01 | 0.01 | Invention |
| A-7 | 0.06 | 0.02 | 0.01 | Invention |
| A-8 | 0.06 | 0.02 | 0.01 | Invention |
| A-9 | 0.06 | 0.03 | 0.02 | Invention |
| A-10 | 0.07 | 0.02 | 0.01 | Invention |
| A-11 | 0.06 | 0.02 | 0.01 | Invention |
| A-12 | 0.06 | 0.01 | 0.01 | Invention |
| A-13 | 0.22 | 0.07 | 0.06 | Comp. Ex. |
| A-14 | 0.08 | 0.03 | 0.03 | Invention |

It is apparent from Table 2 that only the samples according to the present invention are excellent in processing stability and scarcely cause an increase in magenta stain after processing.

Particularly, when the compound (II) or (III) is used in combination with the compound (V), an increase in magenta stain is very small and the samples are superior.

EXAMPLE 2

The following silver halide emulsions (9) to (14) were prepared in the same manner as in the Example 1. Iridium was added in the same way as in Example 1. These emulsions were properly processed by adding sodium thiosulfate at 58° C. to give surface latent image type emulsions.

Emulsions (15) to (18) were prepared according to the method described in EP-0273430 in such a manner that before chemical sensitization was carried out with sodium thiosulfate, $4.0\times10^{-4}$ of the following compound per mol of silver halide was added, there was then added 1 mol % (based on the amount of silver) of ultrafine silver bromide grain emulsion (grain size: 0.05μ) and ripening was carried out at 58° C. for 10 minutes.

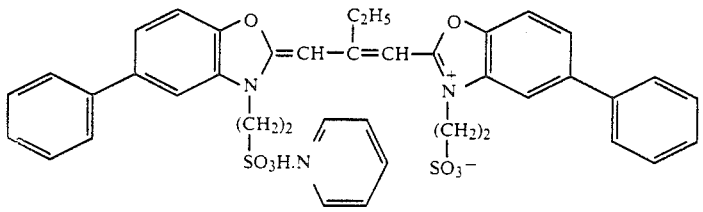

It was confirmed by X-ray diffractometry, electron microscopy and EDX method the emulsions (15) to (18) had silver bromide-localized phase having a silver bromide content 60 mol % in the vicinity of the apexes of grains.

$1.0\times10^{-8}$ mol of iridium ion per mol of silver was added to the emulsions (15) and (16) in the same manner as in the emulsions (9) to (14), while iridium ion was added to the emulsions (17) and (18) by previously incorporating said ion in the ultrafine silver bromide grains.

| Shape of Emulsion | Shape | Mean Grain Size (μm) | Halogen Composition (Cl mol %) | Coefficient of Variation |
|---|---|---|---|---|
| (9) | cube | 1.02 | 99 | 0.08 |
| (10) | cube | 0.71 | 99 | 0.08 |
| (11) | cube | 0.52 | 99 | 0.08 |
| (12) | cube | 0.40 | 99 | 0.08 |

-continued

| Shape of Emulsion | Shape | Mean Grain Size (μm) | Halogen Composition (Cl mol %) | Coefficient of Variation |
|---|---|---|---|---|
| (13) | cube | 0.44 | 99 | 0.07 |
| (14) | cube | 0.36 | 99 | 0.08 |
| (15) | cube | 0.53 | 99* | 0.08 |
| (16) | cube | 0.40 | 90* | 0.08 |
| (17) | cube | 0.53 | 99** | 0.09 |
| (18) | cube | 0.41 | 99** | 0.07 |

*, **Grains had silver halide-localized phase having a silver bromide content of 60 mol % in the vicinity of the apexes of grains.
**The silver bromide-localized phase contained iridium ion.

A paper support (both sides thereof being laminated with polyethylene) was coated with the following layers to prepare a multi-layer color photographic paper (B-1) having the following structure. Coating solutions were prepared in the following manner.

Preparation of Coating Solution for First Layer 19.1 9 of yellow coupler ($ExY_2$) and 4.4 g of dye image stabilizer (Cpd-7) were dissolved in 27.2 cc of ethyl acetate and 7.7 cc of solvent (Solv-5). The resulting solution was emulsified and dispersed in 185 cc of a 10% aqueous gelatin solution containing 8 cc of 10% sodium dodecylbenzenesulfonate. Separately, $5.0\times10^{-4}$ mol of the following blue-sensitive sensitizing dye per mol of silver was added to a silver chlorobromide emulsion (silver bromide: 1.0 mol %, 70 g of Ag per kg was contained). The resulting emulsion and the above emulsified dispersion were mixed and dissolved. A coating solution for first layer was prepared so as to give the following composition. Coating solutions for the second to seventh layers were prepared in the same way as in the preparation of the coating solution for the first layer.

Sodium salt of 1-oxy-3,5-dichloro-s-triazine was used as the hardening agent for gelatin in each layer.

The following spectral sensitizing dyes for the following layers were used.

Blue-sensitive Emulsion Layer

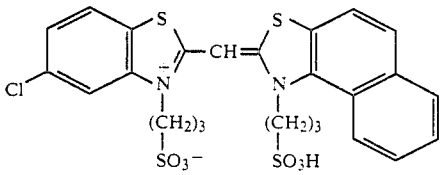

($5.5\times10^{-4}$ mol per mol of silver halide)

Green-sensitive Emulsion Layer

-continued
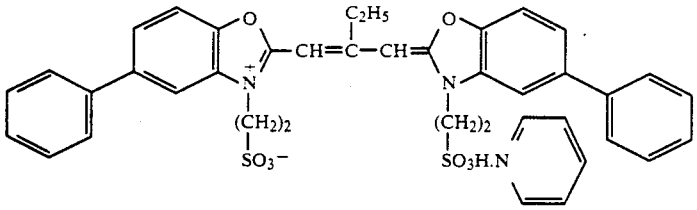
($4.0 \times 10^{-4}$ mol per mol of silver halide)
and
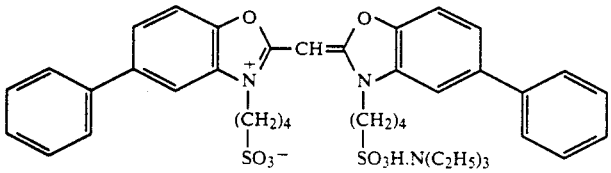
($7.0 \times 10^{-5}$ mol per mol of silver halide)
Red-sensitive Emulsion Layer
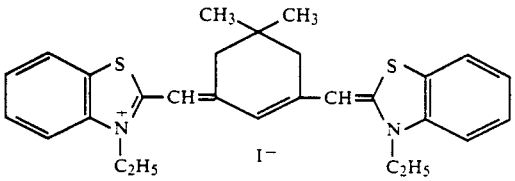
($0.9 \times 10^{-4}$ mol per mol of silver halide)
$2.6 \times 10^{-3}$ mol of the following compound per mol of silver halide was added to red-sensitive emulsion layer.
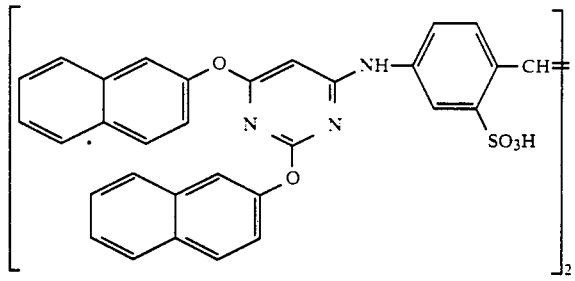
The following dye was added to emulsion layers to present irradiation.
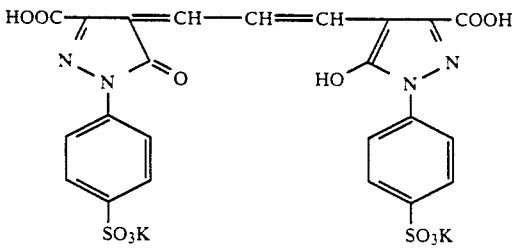
and -continued

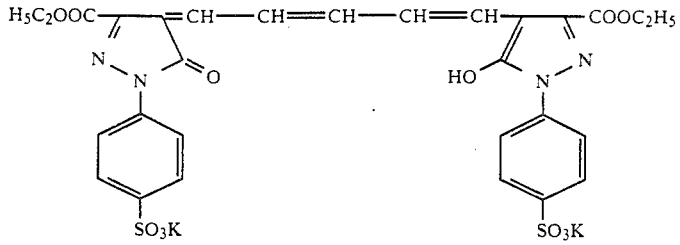

Layer Structure

Each layer had the following composition. Numerals represent coating weight (g/m²). The amounts of the silver halide emulsions are represented by coating weight in terms of silver.

Support

Polyethylene-laminated paper [polyethylene on the side of the first layer contained white pigment ($TiO_2$) and bluish dye (ultramarine)]

| | |
|---|---|
| First Layer: Blue-sensitive Layer | |
| Silver halide emulsions (9) + (10) | 0.30 |
| Gelatin | 1.86 |
| Yellow coupler ($ExY_2$) | 0.82 |
| Dye image stabilizer (Cpd-7) | 0.19 |
| Solvent (Solv-5) | 0.35 |
| Second Layer: Color Mixing Inhibiting Layer | |
| Gelatin | 0.99 |
| Color mixing inhibitor (Cpd-8) | 0.08 |
| Third Layer: Green-sensitive Layer | |
| Silver halide emulsions (11) + (12) | 0.13 |
| Gelatin | 1.24 |

-continued

| | |
|---|---|
| Magenta coupler (I-5) | 0.31 |
| Solvent (Solv-6) | 0.42 |
| Fourth Layer: Ultraviolet Light Absorbing Layer | |
| Gelatin | 1.58 |
| Ultraviolet light absorber (UV-2) | 0.62 |
| Color mixing inhibitor (Cpd-9) | 0.05 |
| Solvent (Solv-7) | 0.24 |
| Fifth Layer: Red-sensitive Layer | |
| Silver halide emulsions (13) + (14) | 0.23 |
| Gelatin | 1.34 |
| Cyan coupler ($ExC_2$) | 0.34 |
| Dye image stabilizer (Cpd-10) | 0.17 |
| Polymer (Cpd-11) | 0.40 |
| Solvent (Solv-8) | 0.23 |
| Sixth Layer: Ultraviolet Light Absorbing Layer | |
| Gelatin | 0.53 |
| Ultraviolet light absorber (UV-2) | 0.21 |
| Solvent (Solv-7) | 0.08 |
| Seventh Layer: Protective Layer | |
| Gelatin | 1.33 |
| Acrylic-modified copolymer of polyvinyl alcohol (degree of modification: 17%) | 0.17 |
| Liquid paraffin | 0.03 |

($ExY_2$) Yellow Coupler

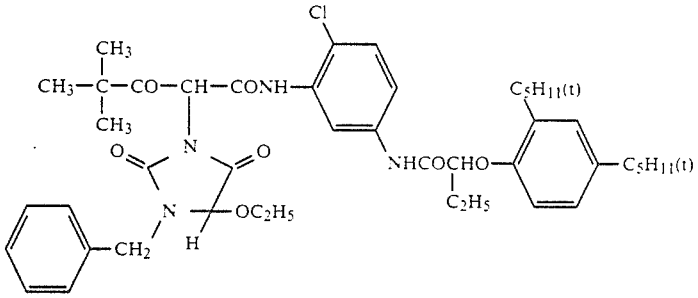

($ExC_2$) Cyan Coupler

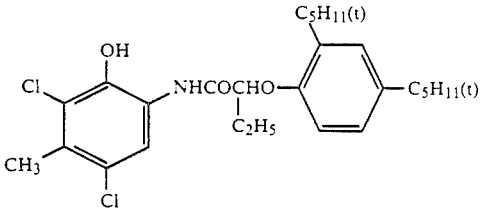

(Cpd-7) Dye image stabilizer

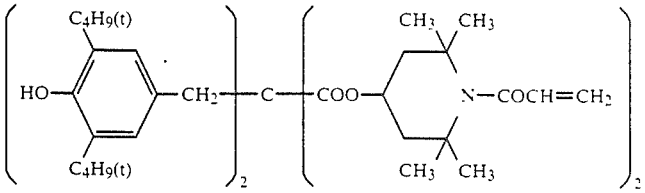

-continued
(Cpd-8) Color mixing inhibitor
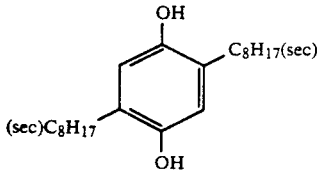
(Cpd-9) Color mixing inhibitor
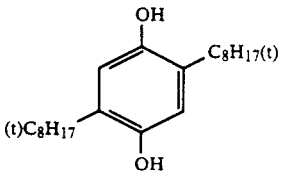
(Cpd-10) Dye image stabilizer
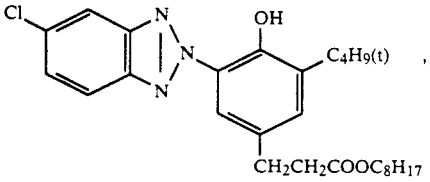
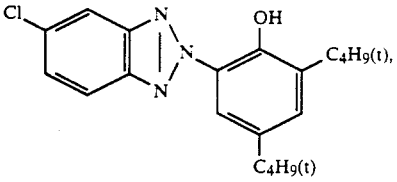
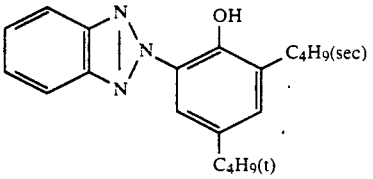
5:8:9 mixture (by weight)
(Cpd-11) Polymer
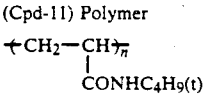
Average MW 80,000
(UV-2) Ultraviolet light absorber
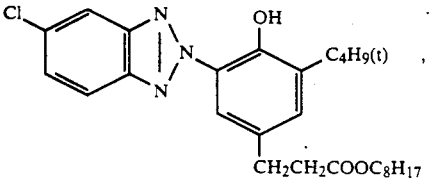
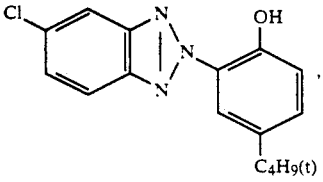

-continued

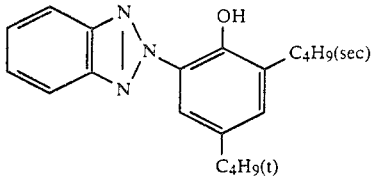

2:9:8 mixture (by weight)

(Solv-5) Solvent

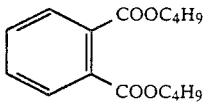

(Solv-6) Solvent

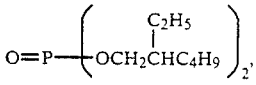

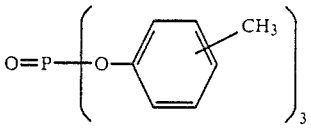

1:1 mixture (by weight)

(Solv-7) Solvent
$O{=}P{+}O{-}C_9H_{19}(iso))_3$ (Solv-8) Solvent

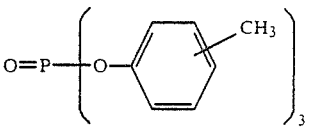

Samples (B-2) to (B-8) were prepared in the same way as in the preparation of the multi-layer color photographic material (B-1) except that the third layer was modified as shown in Table 3.

Besides, the emulsions (15)+(16) and the emulsions (17)+(18) in place of the emulsions (11)+(12) were used for the samples (B-7) and (B-8), respectively. No green-sensitive sensitizing dye was added during the preparation of the coating solution. An equimolar amount of magenta coupler was replaced. $4\times10^{-1}$ mol of the compounds (II) or (III) and $1\times10^{-1}$ mol of the compound (V) were added during the preparation of the emulsified dispersion, each amount being per mol of magenta coupler. $8\times10^{-4}$ mol of the compound (IV) per mol of silver was added during the preparation of the coating solution.

TABLE 3

| Sample No. | Magenta Coupler (I) | Compound (II) or (III) | Compound (V) | Compound (IV) |
|---|---|---|---|---|
| B-1 | I-5 | — | — | — |
| B-2 | I-5 | II-31 | — | — |
| B-3 | I-5 | II-31 | — | IV-4 |
| B-4 | I-5 | II-31 | V-1 | IV-4 |
| B-5 | I-5 | II-31 | V-1 | IV-17 |
| B-6 | I-5 | II-31 | V-1 | IV-4 |
| B-7 | I-5 | II-31 | V-1 | IV-6 |
| B-8 | I-5 | II-31 | V-1 | IV-4 |

The samples were exposed in the same manner as in Example 1 and processed in the following manner.

| Processing Stage | Temperature | Time |
|---|---|---|
| Color Development | 35° C. | 45 sec |
| Bleaching-fixing | 30 to 35° C. | 45 sec |
| Rinse (1) | 30 to 35° C. | 20 sec |
| Rinse (2) | 30 to 35° C. | 20 sec |
| Rinse (3) | 30 to 35° C. | 20 sec |
| Rinse (4) | 30 to 35° C. | 30 sec |
| Drying | 70 to 80° C. | 60 sec |

Three tank countercurrent system of rinse (4) to (1) was used.

Each processing solution had the following composition

| Color Developing Solution | |
|---|---|
| Water | 800 ml |
| Ethylenediamine-N,N,N',N'-tetra-methylenephosphonic acid | 1.5 g |
| Methyltriethylenediamine(1,4-diazabicyclo[2,2,2]octane) | 5.0 g |
| Sodium chloride | 1.4 g |
| Potassium carbonate | 25 g |
| N-Ethyl-N-(β-methanesulfonamido-ethyl)-3-methyl-4-aminoaniline sulfate | 5.0 g |
| N,N-Bis(carboxymethyl)hydrazine | 5.0 g |
| Fluorescent brightener (UNITEX CK, a product of Ciba-Geigy A.G.) | 2.0 g |
| Add water | 1000 ml |
| pH (25° C.) | 9.90, 10.10, 10.30 |

-continued

| Bleaching-fixing Solution | |
|---|---|
| Water | 400 ml |
| Ammonium thiosulfate (70%) | 100 ml |
| Sodium sulfite | 18 g |
| Ethylenediaminetetraacetic acid iron(III) ammonium | 55 g |
| Disodium ethylenediaminetetraacetate | 3 g |
| Ammonium bromide | 40 g |
| Glacial acetic acid | 8 g |
| Add water | 1000 ml |
| pH (25° C.) | 5.5 |

Rinsing Solution

Ion-exchanged water (concentration of each of calcium and magnesium being not higher than 3 ppm).

Processing stability and magenta stain were evaluated in the same way as in Example 1. The evaluation of processing stability was made by comparing the samples processed with the color developing solution under pH conditions of 9.90 and 10.30. The evaluation of magenta stain was made by using the samples processed with the color developing solution having a pH of 10.10. The results are shown in Table 4.

TABLE 4

| Sample No. | Processing Stability | Magenta Stain 60° C. 70% 14 Days | Magenta Stain Room Temp. 100 Days | Remarks |
|---|---|---|---|---|
| B-1 | 0.18 | 0.22 | 0.21 | Comp. Ex. |
| B-2 | 0.28 | 0.12 | 0.12 | Comp. Ex. |
| B-3 | 0.06 | 0.06 | 0.06 | Invention |
| B-4 | 0.05 | 0.02 | 0.01 | Invention |
| B-5 | 0.06 | 0.02 | 0.02 | Invention |
| B-6 | 0.05 | 0.02 | 0.01 | Invention |
| B-7 | 0.06 | 0.01 | 0.01 | Invention |
| B-8 | 0.03 | 0.01 | 0.01 | Invention |

It is apparent from Table 4 that only the samples of the present invention are excellent in processing stability and scarcely cause an increase in magenta stain after processing. Particularly, when the compound (II) or (III) is used in combination with the compound (V), an excellent effect can be obtained. When grains have silver bromide-localized phase in the vicinity of the apexes thereof, effect is remarkable.

EXAMPLE 3

A sample (C-1) was prepared in the same way as in Example 2 except that a polyethylene terephthalate support having a thickness of 175 μm and containing 10 wt % of barium sulfate powder (degree of dispersion: 0.12) was used in place of the paper support used for the sample (B-1).

Further, samples (C-2) to (C-5) was prepared by modifying the sample (C-1) as shown in Table 5.

$4\times10^{-1}$ mol of the compound (II) or (III) and $1\times10^{-1}$; mol of the compound (V) were added during the preparation of the emulsified dispersion. each amount being per mol of magenta coupler. $8\times10^{-4}$ mol of the compound (IV) per mol of silver in the third layer was added during the preparation of the coating solution for multi-layer structure.

TABLE 5

| Sample No. | Magenta Coupler (I) | Compound (II) or (III) | Compound (V) | Compound (IV) |
|---|---|---|---|---|
| C-1 | I-5 | — | — | — |
| C-2 | I-5 | II-31 (added to 3rd layer) | V-1 (added to 3rd layer) | IV-4 (added to 3rd layer) |
| C-3 | I-5 | II-31 (added to 1st layer) | V-1 (added to 1st layer) | IV-4 (added to 3rd layer) |
| C-4 | I-5 | II-31 (added to 4th layer) | V-1 (added to 4th layer) | IV-4 (added to 3rd layer) |
| C-5 | I-5 | II-31 (added to 5th layer) | V-1 (added to 5th layer) | IV-4 (added to 3rd layer) |

The processing stability and magenta stain of the above samples were evaluated in the same way as in Example 2. The results are shown in Table 6.

TABLE 6

| Sample No. | Processing Stability | Magenta Stain 60° C. 70% 14 Days | Magenta Stain Room Temp. 100 Days | Remarks |
|---|---|---|---|---|
| C-1 | 0.18 | 0.22 | 0.21 | Comp. Ex. |
| C-2 | 0.05 | 0.02 | 0.01 | Invention |
| C-3 | 0.05 | 0.03 | 0.02 | Invention |
| C-4 | 0.05 | 0.02 | 0.01 | Invention |
| C-5 | 0.05 | 0.03 | 0.02 | Invention |

It is clear from Table 6 that the effect of the present invention is remarkable even when the compounds (II), (III) and (V) are added to the layers other than the third layer.

EXAMPLE 4

Emulsions (19) to (34) given in Table 7 were prepared in the same way as in the preparation of the emulsions (15) and (16) of Example 2 except that an aqueous solution of potassium hexachloro rhodate yellow prussiate was used in place of an aqueous solution of iridium(III) chloride.

Further, the silver halide emulsions of the third layer of Sample (B-1) to (B-8) of Table 3 of Example 2 were modified as shown in Table 8 to prepare samples (D-1) to (D-8).

TABLE 7

| Emulsion No. | Cl Content | Size | Coefficient of Variation | Metal Ion | Amount of Metal Ion (per mol of silver) |
|---|---|---|---|---|---|
| (19) | 99 | 0.53 | 0.08 | — | — |
| (20) | 99 | 0.40 | 0.08 | — | — |
| (21) | 99 | 0.53 | 0.08 | Iridium | $1.0\times10^{-10}$ |
| (22) | 99 | 0.40 | 0.08 | " | $1.0\times10^{-10}$ |
| (23) | 99 | 0.52 | 0.08 | " | $1.0\times10^{-9}$ |
| (24) | 99 | 0.41 | 0.08 | " | $1.0\times10^{-9}$ |
| (25) | 99 | 0.53 | 0.08 | " | $1.0\times10^{-3}$ |
| (26) | 99 | 0.40 | 0.08 | " | $1.0\times10^{-3}$ |
| (27) | 99 | 0.52 | 0.08 | Rhodium | $1.0\times10^{-9}$ |
| (28) | 99 | 0.41 | 0.08 | " | $1.0\times10^{-9}$ |
| (29) | 99 | 0.52 | 0.08 | " | $1.0\times10^{-3}$ |
| (30) | 99 | 0.41 | 0.08 | " | $1.0\times10^{-3}$ |
| (31) | 99 | 0.52 | 0.08 | Iron | $1.0\times10^{-9}$ |
| (32) | 99 | 0.41 | 0.08 | " | $1.0\times10^{-9}$ |
| (33) | 99 | 0.53 | 0.08 | " | $1.0\times10^{-3}$ |

TABLE 7-continued

| Emulsion No. | Cl Content | Size | Coefficient of Variation | Metal Ion | Amount of Metal Ion (per mol of silver) |
|---|---|---|---|---|---|
| (34) | 99 | 0.40 | 0.08 | " | $1.0 \times 10^{-3}$ |

TABLE 8

| Sample No. | Emulsion of Third Layer |
|---|---|
| D-1 | (19) + (20) |
| D-2 | (21) + (22) |
| D-3 | (23) + (24) |
| D-4 | (25) + (26) |
| D-5 | (27) + (28) |
| D-6 | (29) + (30) |
| D-7 | (31) + (32) |
| D-8 | (33) + (34) |

The processing stability and magenta stain of the above samples were evaluated in the same way as in Example 2. The results are shown in Table 9.

TABLE 9

| Sample No. | Processing Stability | Magenta Stain 60° C. 70% 14 Days | Magenta Stain Room Temp. 100 Days | Remarks |
|---|---|---|---|---|
| D-1 | 0.22 | 0.03 | 0.02 | Comp. Ex. |
| D-2 | 0.18 | 0.03 | 0.02 | Comp. Ex. |
| D-3 | 0.07 | 0.02 | 0.01 | Invention |
| D-4 | 0.05 | 0.02 | 0.01 | Invention |
| D-4 | 0.05 | 0.02 | 0.01 | Invention |
| D-5 | 0.04 | 0.02 | 0.01 | Invention |
| D-6 | 0.04 | 0.02 | 0.01 | Invention |
| D-7 | 0.04 | 0.02 | 0.01 | Invention |
| D-8 | 0.04 | 0.02 | 0.01 | Invention |

It is clear from Table 9 that only the samples, wherein silver halide grains contain at least $10^{-9}$ mol (per mol of silver) of Group VIII metal ion of the Periodic Table, Group II metal ion, lead ion or thallium ion, according to the present invention are excellent in processing stability and scarcely cause an increase in magenta stain.

EXAMPLE 5

Emulsions (35) and (36) were prepared in the same way as in the preparation of the emulsions (11) and (12) of Example 2 except that sodium thiosulfate and gold chloride were used during the chemical ripening of the emulsions (35) and (36) to prepare them as surface latent image type emulsions.

Samples (E-1) to (E-6) were prepared by replacing the emulsions (11) and (12) of the third layers of the samples (B-1) to (B-6) of Example 2 with the emulsions (35) and (36). $1 \times 10^{-5}$ mol of the following compound per mol of silver was added to third layer of the samples (E-1) to (E-6) during the preparation of coating solution.

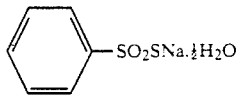

The processing stability and magenta stain of the above samples were evaluated in the same way as in Example 2. The results are shown in Table 10.

TABLE 10

| Sample No. | Processing Stability | Magenta Stain 60° C. 70% 14 Days | Magenta Stain Room Temp. 100 Days | Remarks |
|---|---|---|---|---|
| D-1 | 0.20 | 0.22 | 0.22 | Comp. Ex. |
| D-2 | 0.30 | 0.13 | 0.14 | Comp. Ex. |
| D-3 | 0.03 | 0.03 | 0.03 | Invention |
| D-4 | 0.02 | 0.02 | 0.02 | Invention |
| D-5 | 0.01 | 0.01 | 0.01 | Invention |
| D-6 | 0.01 | 0.01 | 0.01 | Invention |

It is clear from Table 10 that the effects obtained by the present invention are particularly remarkable in comparison with Table 10 when the samples are sensitized with the gold sensitizing agent and the sulfur sensitizing agent.

EXAMPLE 6

Samples (F-1) to (F-4) were prepared in the same was as in the preparation of the Samples (B-3) and (B-4) of Example 2 except that each of the following solvents was used in place of solvent (Solv-6) in the green-sensitive layer.

| Sample No. | Magenta Coupler (I) | Compound (II) or (III) | Compound (V) | Compound (IV) | Solvent |
|---|---|---|---|---|---|
| B-3 | I-5 | II-31 | — | IV-4 | Solv-6 |
| F-1 | I-5 | II-31 | — | IV-4 | Solv-6b |
| F-2 | I-5 | II-31 | — | IV-4 | Solv-6c |
| B-4 | I-5 | II-31 | V-1 | IV-4 | Solv 6 |
| F-3 | I-5 | II-31 | V-1 | IV-4 | Solv-6b |
| F-4 | I-5 | II-31 | V-1 | IV-4 | Solv-6c |
| B-1 | I-5 | — | — | — | Solv-6 |

The dielectric constants of Solv-6, Solv-6b and Solv-6c were 6.1, 7.3 and 5.2, respectively.

Solvent (Solv-6b)

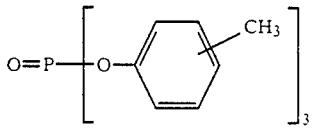

Solvent (Solv-6c)

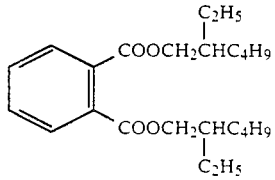

The processing stability and magenta stain of the above samples were evaluated in the same manner as in Example 2. The results are shown in Table 11.

TABLE 11

| Sample No. | Processing Stability | Magenta Stain 60° C. 70% 14 Days | Magenta Stain Room Temp. 100 Days |
|---|---|---|---|
| B-3 | 0.06 | 0.06 | 0.06 |
| F-1 | 0.05 | 0.08 | 0.08 |
| F-2 | 0.08 | 0.04 | 0.04 |
| B-4 | 0.05 | 0.02 | 0.01 |
| F-3 | 0.04 | 0.04 | 0.04 |
| F-4 | 0.08 | 0.02 | 0.01 |
| B-1 | 0.18 | 0.22 | 0.21 |

It is clear from Table 11 that the effect of the present invention is particularly more remarkable when the magenta coupler is dispersed by using the high-boiling organic solvents having a dielectric constant of 6.1, as compared with the cases where the magenta coupler is dispersed by using the high-boiling organic solvents having a dielective constant of 5.2 and 7.3.

The present invention effectively solve such problems that sensitivity and gradation are affected by change in the pH value of the color developing solution and magenta stain is increased after processing.

The effects obtained by the present invention are particularly remarkable when the compound (II) or (III) is used in combination with the compound (V). The effects are remarkable with the reflection type color photographic material containing high silver chloride emulsion in particular. Besides, the effects are also remarkable with the pyrazoloazole couplers being dispersed using a high-boiling point organic solvent having a dielectric constant of from 5.3 to 6.7.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material containing a reflective support having thereon at least one silver halide emulsion layer containing (1) silver halide grains comprising silver chloride or silver chlorobromide grains having an average silver chloride content of not less than 90 mol % and substantially no silver iodide and (2) at least one member of pyrazoloazole couplers represented by general formula (I), and wherein said silver halide color photographic material further contains at least one member of compounds represented by general formulas (II) and (III) and at least one member of compounds represented by general formula (IV), and wherein the silver halide grains further contain at least $10^{-9}$ mol per mol of silver chloride of a Group VIII metal ion of the Periodic Table, a Group II transition metal ion, lead ion or thallium ion which is incorporated therein during the formation of the silver halide grains or during physical ripening of the silver halide grains:

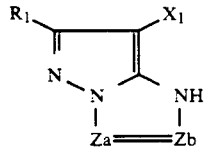

(I)

wherein Za and Zb each represent $$=\overset{R_2}{\overset{|}{C}}- \text{ or } =N-;$$

$R_1$ and $R_2$ each represent a hydrogen atom or a substituent group; $X_1$ represents a hydrogen atom or a group which is eliminated by a coupling reaction with an oxidant of an aromatic primary amine developing agent; when Za=Zb linkage is a carbon-to-carbon double bond, the linkage may be a portion of the aromatic ring; a dimer or polymer may be formed by $R_1$, $R_2$ or $X_1$; at least one of $R_1$ and $R_2$ is a group which is attached to the pyrazoloazole nucleus through a secondary or tertiary carbon;

$$R_3\text{-}(A)_n\text{-}X_2 \qquad \text{(II)}$$

$$R_4\text{-}\underset{\underset{B}{|}}{C}=Y \qquad \text{(III)}$$

wherein $R_3$ and $R_4$ each represent an aliphatic group, an aromatic group or a heterocyclic ring; $X_2$ represents a group which is eliminated by a reaction with an aromatic amine developing agent; A represents a group which forms a chemical bond by a reaction with the aromatic primary amine developing agent; n represents 0 or 1; B represents a hydrogen atom, an aliphatic group, an aromatic group, a heterocyclic group, an acyl group or a sulfonyl group; Y represents a group which accelerates the addition of an aromatic amine developing agent to the compound having the formula (III); and $R_3$ and $X_2$ or Y and $R_4$ or B may be combined together to form a ring structure:

$$D\text{—}S\text{—}M_2 \qquad \text{(IV)}$$

wherein $M_2$ represents a hydrogen atom, a cation or —S—D; and D represents a residue of a heterocyclic ring containing at least one nitrogen atom.

2. The silver halide color photographic material as in claim 1, wherein said photographic material contains further at least one member of compounds represented by the following general formula (V);

$$R\text{—}Z \qquad \text{(V)}$$

wherein R represents an aliphatic group, an aromatic group or a heterocyclic ring; and Z represents a nucleophilic group or a group which is decomposed in the photographic material to release a nucleophilic group.

3. The silver halide color photographic material as in claim 1, wherein at least one member of the pyrazoloazole couplers having the formula (I) is dispersed by using a high-boiling organic solvent having a dielectric constant of from 5.3 to 6.7.

4. The silver halide color photographic material as in claim 1, wherein silver halide grains in the emulsion layer containing at least one member of the pyrazoloazole couplers having the formula (I) contain substantially no silver iodide and have an average silver chloride content of not lower than 95 mol %.

5. The silver halide color photographic material as in claim 2, wherein silver halide grains in the emulsion layer containing at least one member of the pyrazoloazole couplers having the formula (I) contain substantially no silver iodide and have an average silver chloride content of not less than 95 mol %.

6. The silver halide color photographic material as in claim 1, wherein said pyrazoloazole couplers are compounds having the following formula (VI), (VII), (VIII), (IX) or (X),

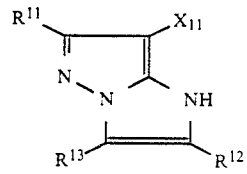

(VI)

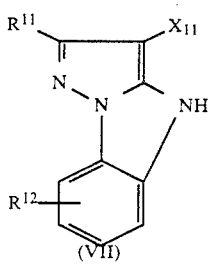

(VII)

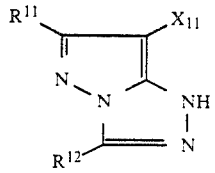

(VIII)

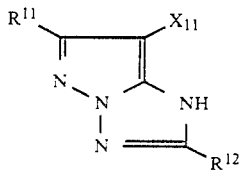

(IX)

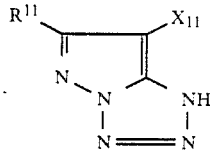

(X)

wherein, $R^{11}$, $R^{12}$ and $R^{13}$ each represent a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; $X_{11}$ is a hydrogen atom, a halogen atom, a carboxyl group or a group which is bonded to a carbon atom at the coupling position through an oxygen, nitrogen or sulfur atom and is eliminated by coupling; $R^{11}$, $R^{12}$ and $R^{13}$ may be the same or different and $R^{11}$, $R^{12}$, $R^{13}$ or $X_{11}$ may be a divalent group to form a bis-compound or a polymer.

7. The silver halide color photographic material as in claim 6 wherein said pyrazoloazole couplers are compounds having the formulas (VI), (VIII) or (IX).

8. The silver halide color photographic material as in claim 1, wherein said aliphatic group represented by $R_3$, $R_4$ and B is a straight-chain, branched or cyclic alkyl group, a straight-chain, branched or cyclic alkenyl group or a straight-chain, branched of cyclic alkynyl group, which may be substituted; said aromatic group represented by $R_3$, $R_4$ and B is a carbon ring aromatic group, or a heterocyclic aromatic group and the aromatic ring may have at least one substituent; and said heterocyclic ring represented by $R_3$, $R_4$ and B is a group having a 3-membered to 10-membered ring structure composed of a carbon atom, oxygen atom, nitrogen atom, sulfur atom and hydrogen atom, which may be a saturated ring or an unsaturated ring, or may be substituted.

9. The silver halide color photographic material as in claim 1, wherein said group which is eliminated by reaction with an aromatic amine developing agent represented by $X_2$ is a group attached to A through an oxygen atom, sulfur atom or nitrogen atom, or a halogen atom.

10. The silver halide color photographic material as in claim 1, wherein said group which forms a chemical bond by reaction with the aromatic primary amine developing agent represented by A is a group containing an atom having a low electron density.

11. The silver halide color photographic material as in claim 1, wherein said group which accelerates the addition of an aromatic amine developing agent to the compound having the formula (III), represented by Y, is oxygen atom, sulfur atom

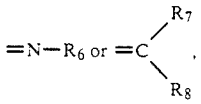

wherein $R_6$, $R_7$ and $R_8$ each represent a hydrogen atom, an aliphatic group or a sulfonyl group and $R_7$ and $R_8$ may combine together to form a ring structure.

12. The silver halide color photographic material as in claim 1, wherein said compound represented by formula (II) is a compound having a second-order reaction constant $k_2$(80° C.) (in terms of the reaction with p-anisidine) of from $1\times10^{-1}$ l/mol.sec to $1\times10^{-5}$ l/mol.sec, represented by the following formulas (II-a), (II-b), (II-c) and (II-d),

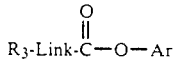

(II-a)

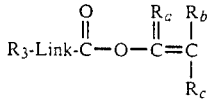

(II-b)

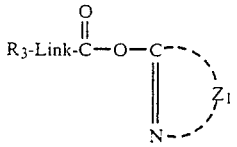

(II-c)

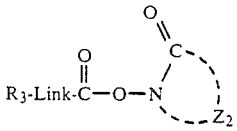

(II-d)

wherein $R_3$ has the same meaning as in the definition of $R_3$ is the formula (II); Link is a single bond of —O—; Ar is an aromatic group which has the same meaning as in the definitions of $R_3$, $R_4$ and B in the formulas (II) and (III) with the proviso that it is not necessary that a group released therefrom by the reaction with the aromatic amine developing agent is a group useful as a photographic reducing agent; $R_a$, $R_b$ and $R_c$ may be the same or different groups and each is a hydrogen atom, an aliphatic group, an aromatic group, a heterocyclic group, an alkoxy group, an aryloxy group, a heterocyclic oxy group, an alkylthio group, an arylthio group, a heterocyclic thio group, an amino group, an alkylamino group, an acyl group, an amido group, a sulfonamido group, a sulfonyl group, an alkoxycarbonyl group, sulfo group, carboxyl group, hydroxyl group, an acyloxy group, a ureido group, a urethane group, a carbamoyl group or a sulfamoyl group; $R_a$ and $R_b$ or $R_b$ and $R_c$ may be combined together to form a 5-membered to 7-membered heterocyclic ring which may be optionally substituted, may form a spiro ring or a bicyclo ring, or may be condensed with an aromatic ring; and $Z_1$ and $Z_2$ each are a non-metallic atomic group required for forming a 5-membered to 7-membered heterocyclic ring which may be optionally substituted, may form a spiro ring or a bicyclo ring, or may be condensed with an aromatic ring.

13. The silver halide color photographic material as in claim 2, wherein said aliphatic group represented by R is a straight-chain, branched or cyclic alkyl group, a straight-chain, branched or cyclic alkenyl group or a straight-chain, branched or cyclic alkynyl group, which may be substituted; said aromatic group represented by R is a carbon ring aromatic group, or a heterocyclic aromatic group, and the aromatic ring may have at least one substituent; and said heterocyclic ring represented by R is a group having a 3-membered to 10-membered ring structure composed of a carbon atom, oxygen atom, nitrogen atom, sulfur atom and hydrogen atom, which may be a saturated ring or an unsaturated ring, or may be substituted.

14. The silver halide color photographic material as in claim 2, wherein said nucleophilic group or said group which is decomposed in the photographic material to release a nucleophilic group, represented by Z, is a nucleophilic group where the atom chemically bonded directly to the oxidant of the aromatic amine developing agent is an oxygen atom, sulfur atom or nitrogen atom.

15. The silver halide color photographic material as in claim 2, wherein said compound represented by formula (V) is a compound having the following formula (V-a)

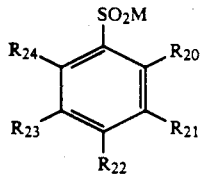

(V-a)

Wherein $R_{20}$, $R_{21}$, $R_{22}$, $R_{23}$ and $R_{24}$ each represent hydrogen atom, an aliphatic group, an aromatic group, a heterocyclic group, a halogen atom, $$-SR_{36},\ -OR_{36},\ -\underset{\underset{R_{37}}{|}}{N}-R_{36},$$

wherein $R_{36}$ and $R_{37}$ each represent hydrogen atom, an aliphatic group, an aromatic group, an acyl group or a sulfonyl group, and $R_{36}$ and $R_{37}$ may be the same or different, an acyl group, an alkoxycarbonyl group, an aryloxycarbonyl group, a sulfonyl a sulfonamide group, a sulfamoyl group, an ureido group, a urethane group, a carbamoyl group, sulfo group, carboxyl group, nitro group, cyano group, an alkoxalyl group, an aryloxalyl group, a sulfonyloxy group, $$-PR_{38}R_{39},\ -\overset{\overset{O}{\|}}{P}R_{38}R_{39},\ -\overset{\overset{S}{\|}}{P}R_{38}R_{39},$$

wherein $R_{38}$ and $R_{39}$ each represent hydrogen atom, an aliphatic group, an aromatic group, an alkoxy group or an aryloxy group and $R_{38}$ and $R_{39}$ may be the same or different; and M represents an atom capable of forming an inorganic salt or an organic salt, an atomic group capable of forming an inorganic or organic salt, or a group of the formula $$-NHN=C\begin{matrix}R_{25}\\R_{26}\end{matrix},\ -\overset{\overset{R_{27}}{|}}{N}-\overset{\overset{R_{28}}{|}}{N}-SO_2R_{29},$$

$$-\overset{\overset{R_{30}}{|}}{N}-\overset{\overset{R_{31}}{|}}{N}-\underset{\underset{O}{\|}}{C}-R_{32},\ \text{or}\ -\underset{\underset{R_{34}}{|}}{\overset{\overset{OR_{35}}{|}}{C}}-\underset{\underset{O}{\|}}{C}-R_{33},$$

wherein $R_{25}$ and $R_{26}$ may be the same or different groups and each is hydrogen atom, an aliphatic group, an aromatic group or a heterocyclic group, or $R_{25}$ and $R_{26}$ may be combined together to form a 5-membered to 7-membered ring, $R_{27}$, $R_{28}$, $R_{30}$ and $R_{31}$ may be the same or different groups and each is hydrogen atom, an aliphatic group, an aromatic group, a heterocyclic ring, an acyl group, an alkoxycarbonyl group, a sulfonyl group, a ureido group or an urethane group with the proviso that at least one of $R_{27}$ and $R_{28}$ and at least one of $R_{30}$ and $R_{31}$ are hydrogen atom, and $R_{29}$ and $R_{32}$ are each hydrogen atom, an aliphatic group, an aromatic group or a heterocyclic group, and $R_{29}$ is further an alkylamino group, an arylamino group, an alkoxy group, an aryloxy group, an acyl group, an alkoxycarbonyl group or an aryloxycarbonyl group, at least two groups of $R_{27}$, $R_{28}$ and $R_{29}$ may be combined together to form a 5-membered to 7-membered ring, and at least two groups of $R_{30}$, $R_{31}$ and $R_{32}$ may be combined together to form a 5-membered to 7-membered ring, $R_{33}$ is hydrogen atom, an aliphatic group, an aromatic group or a heterocyclic group, $R_{34}$ is hydrogen atom, an aliphatic group, an aromatic group, a halogen atom, an acyloxy group or a sulfonyl group; and $R_{35}$ is hydrogen atom or a hydrolyzable group.

16. The silver halide color photographic material as in claim 1 wherein said silver halide emulsion layer containing substantially no silver iodide contain at least one member of compounds represented by the following formula (p), (q) or (r)

$$Z-SO_2S-M \qquad (p)$$

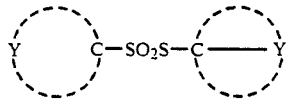

(q)

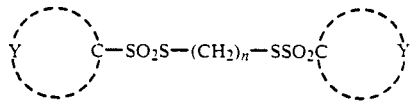

(r)

wherein Z represents an alkyl group, an aryl group or a heterocyclic group, which may be substituted; Y represents an atomic group required for the formation of an aromatic ring or a heterocyclic ring, which may be substituted; M represents a metal atom or an organic cation; and n is an integer of 2 to 10.

17. The silver halide color photographic material as in claim 1, wherein at least one member of said compounds represented by formulas (II) and (III) is used in an amount of $1\times10^{-2}$ to 10 mol per mol of the coupler.

18. The silver halide color photographic material as in claim 2, wherein at least one member of said compounds represented by formula (V) is used in an amount of from $1\times10^{-2}$ to 10 mol per mol of the coupler.

19. The silver halide color photographic material as in claim 1, wherein at least one member of said compounds represented by formula (IV) is used in an amount of from $1\times10^{-6}$ to $1\times10^{-2}$ mol per mol of silver halide.

* * * * *